US010198914B2

(12) United States Patent
Froy et al.

(10) Patent No.: US 10,198,914 B2
(45) Date of Patent: Feb. 5, 2019

(54) GAMING DEVICE FOR UPDATING GAME PLAY IN REAL-TIME

(71) Applicant: IGT CANADA SOLUTIONS ULC, Moncton (CA)

(72) Inventors: David Vincent Froy, Lakeville-Westmorland (CA); Fayez Idris, Dieppe (CA); Jessica Pauli de Castro Bonson, Florianopolis (BR); Andrew McIntyre, Halifax (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 387 days.

(21) Appl. No.: 15/087,331

(22) Filed: Mar. 31, 2016

(65) Prior Publication Data

US 2017/0287287 A1 Oct. 5, 2017

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3246* (2013.01); *G07F 17/3251* (2013.01); *G07F 17/3272* (2013.01)

(58) Field of Classification Search
CPC ..... G07F 17/3295; G07F 17/3209; G07F 17/3211; G07F 17/3246; G07F 17/3251; G07F 17/3272
See application file for complete search history.

(56) References Cited

U.S. PATENT DOCUMENTS

2003/0199305 A1* 10/2003 Mathis ..... G07F 17/32 463/20
2004/0097287 A1* 5/2004 Postrel ..... G07F 17/32 463/41
2005/0113164 A1* 5/2005 Buecheler ..... G07F 17/3239 463/23
2005/0239538 A1* 10/2005 Dixon ..... G07F 17/3267 463/20
2006/0030400 A1* 2/2006 Mathis ..... G07F 17/32 463/20
2007/0082729 A1* 4/2007 Letovsky ..... A63F 13/10 463/23
2009/0036199 A1* 2/2009 Myus ..... G07F 17/3295 463/23

(Continued)

*Primary Examiner* — Corbett B Coburn
(74) *Attorney, Agent, or Firm* — Sage Patent Group

(57) ABSTRACT

A device for playing a skill-based game that modifies the visual representation of the game play using game enhancement elements. A game processor automatically generates game enhancement elements using game data of the skill-based game and computes a game skill level. A game controller is connected to a data storage device and a display screen. The game controller controls the skill-based game, the game controller configured to: render visual representation of game play; detect real-time game play of the game by the player; compute a player skill level based on the detected game play; select a game enhancement element by comparing the game skill level and the player skill level; modify the visual representation of the game play using the one or more selected game enhancement elements; and award the player based on the additional game play and the comparison of the game skill level and the player skill level.

18 Claims, 20 Drawing Sheets

(56) References Cited

U.S. PATENT DOCUMENTS

| | | | | |
|---|---|---|---|---|
| 2009/0258696 | A1* | 10/2009 | Chinn | G07F 17/32 463/20 |
| 2011/0212766 | A1* | 9/2011 | Bowers | G07F 17/32 463/25 |
| 2013/0324229 | A1* | 12/2013 | Arnone | G07F 17/3244 463/25 |
| 2014/0171186 | A1* | 6/2014 | Arnone | G07F 17/32 463/25 |
| 2014/0302898 | A1* | 10/2014 | Vann | G07F 17/326 463/2 |
| 2017/0236382 | A1* | 8/2017 | Colvin | G07F 17/3209 463/17 |
| 2017/0259177 | A1* | 9/2017 | Aghdaie | A63F 13/67 |

* cited by examiner

GAMING DEVICE FOR UPDATING GAME PLAY IN REAL-TIME

FIELD

Embodiments described herein relate to the field of electronic gaming machines. The embodiments described herein particularly relate to the field of providing an enhanced electronic gaming machine with game enhancement elements for skill-based games.

INTRODUCTION

Casinos and other establishments may have video gaming terminals that may include game machines, online gaming systems (that enable users to play games using computer devices, whether desktop computers, laptops, tablet computers or smart phones), computer programs for use on a computer device (including desktop computer, laptops, tablet computers or smart phones), or gaming consoles that are connectable to a display such as a television or computer screen.

Video gaming terminals may be configured to enable users to play games that may require the user to demonstrate or exhibit a skill, which may be referred to as skill-based games. Example skills may be reaction speed, visual and organization skills, coordination skills, audio skills, and tactile skills. A user may win a base line prize by playing in the skill-based game. The user may win a better prize by demonstrating skill when playing the game. Video gaming terminals may be configured to enable users to play a variety of different types of skill-based games.

A user may want to have an engaging experience when playing a game at a video gaming terminal. However, when a user plays a game multiple times, a user may find the game repetitive, and may seek another game to play at a different video gaming terminal. In addition, a player may find a game too difficult or too easy, which may reduce the engagement of the player when playing the game. Further, developing a skill-based game may be tedious and time-consuming as it may be difficult to account for the range of skill levels of the potential players of the skill-based game.

There is a need to immerse the user in their gaming experience at a video gaming terminal and make more efficient use of the physical limitations of the hardware of the video gaming terminal, and therefore it is necessary to innovate by launching new and engaging game machines with improved hardware.

SUMMARY

In one aspect, there is provided a device for a skill-based game comprising: a data storage device for storing game data for the skill-based game; a card reader to receive a token for a player account of a player to initiate the skill-based game; a display screen for displaying the skill-based game; a game processor configured to automatically generate game enhancement elements using the game data and to automatically play the skill-based game using the game data to compute a game skill level; a game controller connected to the data storage device and the display screen to control the skill-based game, the game controller configured to: render visual representation of game play for carrying out the skill-based game based on the game data on the display screen; detect a sufficient amount of real-time game play of the skill-based game by the player; compute a player skill level based on the detected game play by the player, the player skill level computed based on detected real-time game play over a period of time; select one or more game enhancement elements by comparing the game skill level and the player skill level, each game enhancement element linked to the comparison of the game skill level and the player skill level; modify the visual representation of the game play using graphical animation effects based on the one or more selected game enhancement elements to generate an enhanced skill-based game; detect additional real-time game play by the player of the enhanced skill-based game, the additional game play involving interaction with the one or more generated game enhancement elements; and award the player based on the additional game play and the comparison of the game skill level and the player skill level by triggering transfer of virtual credits to the player account of the player using the card reader and the token.

In some embodiments, the one or more generated game enhancement elements comprise modifying, adding, or removing game components for the skill-based game.

In some embodiments, the game enhancement elements comprise a simulated player robot configured to interface with the device to automatically play the skill-based game to compute the game skill level.

In some embodiments, the game processor generates the game enhancement elements by: randomly generating preliminary game enhancement elements based on the game data for selecting to modify the skill-based game; evaluating the preliminary game enhancement elements with a fitness score; selecting at least one of the preliminary game enhancement elements for modification based on the fitness score; modifying the selected at least one preliminary game enhancement element; replacing the preliminary game enhancement elements of step (a) with the modified preliminary game enhancement elements of step (d); and repeating steps (a) to (e) until satisfying stop criteria, the stop criteria defining a set of game enhancement elements corresponding to a plurality of skill levels for playing the skill-based game.

In some embodiments, the game controller computes the player skill level using skill-determining factors.

In some embodiments, the skill-determining factors comprise one or more of: reaction time, memory, coordination, game session length, play behavior, game behavior, game language, game location, game selection, elapsed time with one game, wagering behavior, game type, game theme, wager amounts, wager denominations, play rates, typical bonus values, game brand, prize distributions, amounts of incremental wagers, frequency of wagering, for instance the presence or absence of multiple rounds of wagering in a game, the number of rounds of wagers permitted in a game, maximum wager amounts permitted, minimum wager amounts permitted, amount of wagering, elapsed time between selected events for instance starting a new game, reaction to bonus rounds, reaction to progressive outputs, pay table features, amount of incremental wagers, frequency of wagering, elapsed time for player reaction, amount of wagering, elapsed time between wagers, frequency of player action, game rules, game complexity, ability for a player to control or have an effect on a game outcome, whether an outcome is predetermined, whether parallel wagering is provided, average game speed, average wager amounts, average wager rate, presence or frequency of bonus rounds, presence and frequency of progressive outputs, payout percentages, win rates, win percentages, loss rates, loss percentages, use of special features, frequency of use of special features, number of lines played, total amount wagered, and type of payment received.

In some embodiments, the game controller awards the player based on a portion of the additional game play data corresponding to the player's interaction with the game enhancement elements.

In some embodiments, the data storage device stores bonus game data for a bonus game in the data storage device; and the game controller is further configured to trigger a bonus game based on the additional game play data and the comparison of the game skill level and the player skill level, the bonus game including game enhancement elements.

In some embodiments, at least a portion of the device is implement using a central server coupled to a plurality of gaming machines, and wherein the game controller is further configured to: detect real-time game play of the skill-based game by the player at a first gaming machine; receive from the first gaming machine, game data for the skill-based game and a request to generate the game enhancement elements; and distribute to each of the plurality of gaming machines, the one or more generated game enhancement elements.

In some embodiments, the player skill level is determined in real time or near real time.

In some embodiments, the game processor generates the game enhancement elements in real time or near real time.

In some embodiments, the game controller is configured to: procedurally generate game data; and carry out the skill-based game based on the game data and the procedurally generated game data by the visual rendering on the display screen.

In some embodiments, the game controller is configured to: generate the game enhancement elements based on the game data of the skill-based game while the skill-based game is loading.

In some embodiments, the game controller is configured to: receive input of a preference of the player; and identify the game enhancement element for introducing to the skill-based game based on the preference of the player.

In some embodiments, the game processor is configured to: generate an optimal simulated player based on the game data for the skill-based game, the optimal simulated player corresponding to an optimal skill level for playing the skill-based game; compute the game skill level using the optimal simulated player; and determine whether the player is cheating by comparing the player skill level and to the game skill level as computed using the optimal simulated player.

In some embodiments, the skill-based game is a single-player skill-based game or a multi-player skill-based game.

In another aspect, there is provided a device for playing a skill-based game, the device comprising: a data storage device for storing game data for the skill-based game; a card reader to receive a token for a player account of a player to initiate the skill-based game; a display screen for providing a visual rendering for the skill-based game; a game processor configured to automatically generate game enhancement data using the game data and to automatically play the skill-based game using the game data to compute a game skill level; a game controller connected to the data storage device and the display screen to control the skill-based game, the game controller configured to: render visual representation of game play for carrying out the skill-based game based on the game data; detect real-time game play of the skill-based game by the player; compute a player skill level based on the detected game play by the player, the player skill level over a period of time for the detected real-time game play; select game enhancement data by comparing the game skill level and the player skill level; modify the skill-based game using graphical animation effects based on the selected game enhancement data to generate enhanced game play for the visual rendering; detect additional game play data by the player of the enhanced skill-based game; and award the player based on the additional game play and the comparison of the game skill level and the player skill level by triggering transfer of virtual credits to the player account of the player using the card reader and the token.

In another aspect, there is provided a device for testing a skill-based game, the device comprising: a data storage device for storing game data for the skill-based game; and a game processor configured to: automatically play the skill-based game using the game data to compute a game skill level; generate game testing agents based on the game data for the skill-based game, each game testing agent associated with a player skill level of a plurality of player skill levels for playing the skill-based game; automatically play the skill-based game using the game testing agents; determine game quality scores of the skill-based game based on game play data of the game testing agents; and output game test results for the skill-based game based on the game quality scores and the game skill level, the output game test results for automatically modifying the skill-based game.

In some embodiments, the game processor generates the game testing agents by: randomly generating preliminary game testing agents based on the game data for testing the skill-based game; evaluating the preliminary game testing agents with a fitness score; selecting at least one of the preliminary game testing agents for modification based on the fitness score; modifying the selected at least one preliminary game testing agents; replacing the preliminary game testing agents of step (a) with the modified preliminary game testing agents of step (d); and repeating steps (a) to (e) until satisfying stop criteria, the stop criteria defining a set of game testing agents corresponding to a plurality of skill levels for testing the skill-based game.

In some embodiments, the game quality scores are determined based on the skill-based game's adherence to the game data, responses to game play, performance of game functions within an acceptable time, functionality of the skill-based game as the game data intended, operability of the skill-based game on the device, and achievement of game results as defined by the game data.

Further features and combinations thereof concerning embodiments are described.

DETAILED DESCRIPTION

Figure 1:
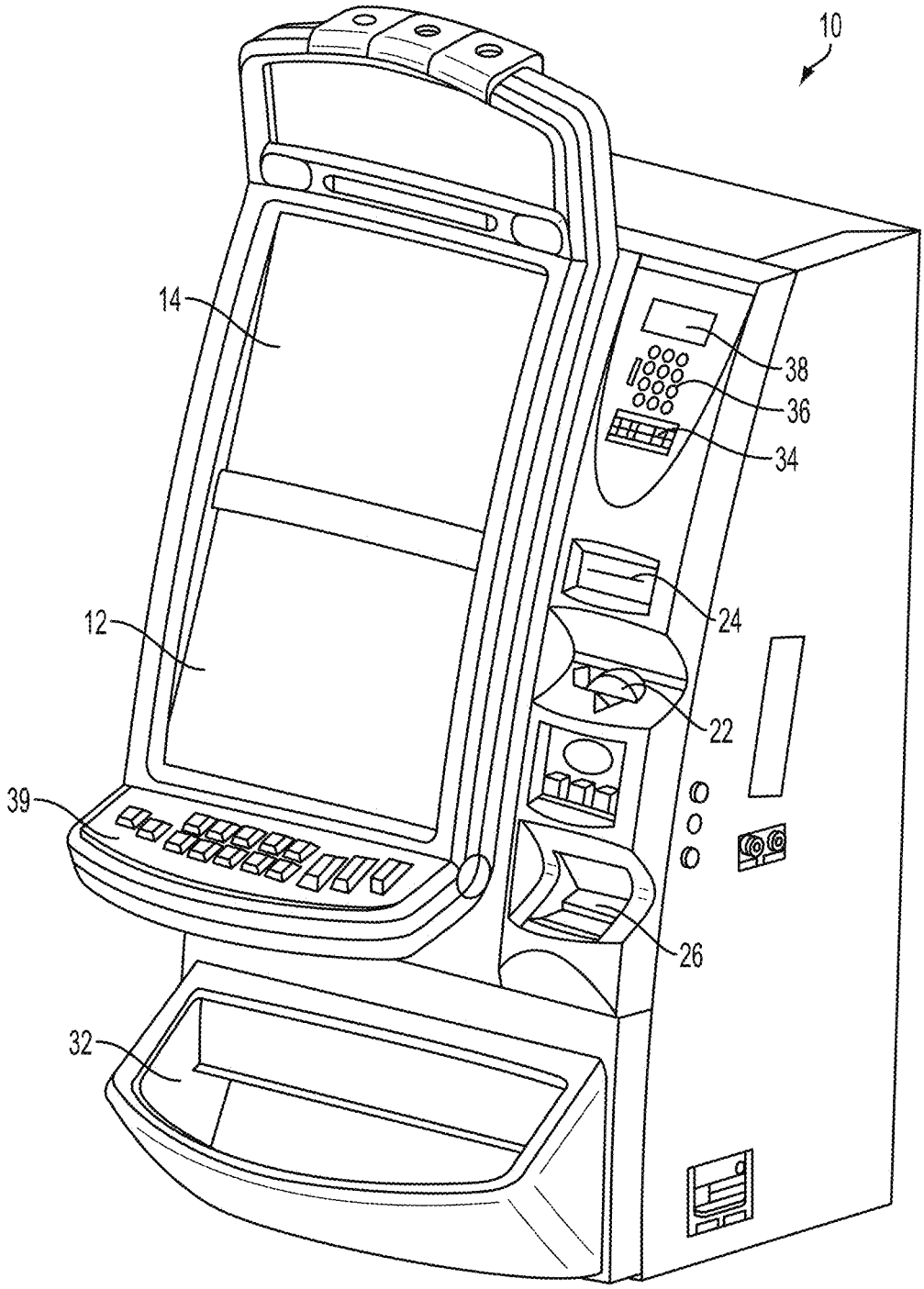
FIG. 1 is a perspective view of an electronic gaming machine for generating gaming enhancement elements and selecting game enhancement elements according to some embodiments.

Embodiments described herein relate to an enhanced electronic gaming machine (EGM) where the player can play a skill-based game, and where the EGM may modify a visual representation of game play by introducing game enhancement elements or game enhancement data. The game enhancement elements or game enhancement data may be selected by EGM by computing the skill level of the player and comparing the skill level of the player with the skill level of the skill-based game. The player may receive an award based on additional game play detected by the EGM relating to the game enhancement elements or game enhancement data.

The EGM may include a data storage device for storing game data for the skill-based game and a card reader to receive a token for player account of a player to initiate the skill-based game. The EGM may include a display screen for providing a visual rendering for the skill-based game. The EGM may include a game processor configured to automatically generate game enhancement elements using the game data and to automatically play the skill-based game using the game data to compute a game skill level from a range of skill levels. The EGM may include a game controller connected to the data storage device and the display screen to control the skill-based game and visual representations thereof. The game controller may be configured to render visual representation of game play for carrying out the skill-based game based on the game data, detect real-time game play of the skill-based game by the player, and compute a player skill level based on the detected game play by the player. The player skill level may be linked to a period of time for the detected real-time game play so the player skill level may vary over different skill-based games and different time periods. Based on the comparison of the game skill level and the player skill level, the game controller may select one or more game enhancement and modify the visual representation of the game play using the one or more selected game enhancement elements to generate an enhanced skill-based game. The game controller may detect additional real-time game play by the player of the enhanced skill-based game. The additional game play may involve interaction with the one or more generated game enhancement elements, such as interaction with virtual opponents. The EGM may award the player based on the additional game play and the comparison of the game skill level and the player skill level by triggering transfer of virtual credits to the player account of the player using the card reader and the token.

The game processor may be configured to automatically generate game enhancement elements using the game data. The game processor may generate the game enhancement elements by randomly generating preliminary game enhancement elements based on the game data for introducing to the skill-based game, evaluating the preliminary game enhancement elements with a fitness score, selecting at least one of the preliminary game enhancement elements for modification based on the fitness score, modifying the selected at least one preliminary game enhancement element, replacing the preliminary game enhancement elements with the modified preliminary game enhancement elements. The EGM may repeat these steps iteratively until a stop criteria is satisfied. The stop criteria may define a set of game enhancement elements corresponding to different skill levels for playing the skill-based game.

The game enhancement elements may comprise modifying, adding, or removing game components from the skill-based game. The game enhancement elements may comprise a simulated player robot configured to interface with the device to automatically play the skill-based game. A simulated player robot may be configured to perform a range of interactions. Based on the computed skill level of the player, the simulated player robot may be configured to interact with a player with a subset of interactions within a range of interactions to provide varying skill levels to play the skill-based game.

The game processor may be configured to automatically generate game enhancement data using the game data and to automatically play the skill-based game using the game data to compute a game skill level. The game controller may select game enhancement data by comparing the game skill level and the player skill level and modify the skill-based game using the selected game enhancement data to generate enhanced game play for the visual rendering.

The game processor may be configured to automatically play the skill-based game using the game data to compute a game skill level, generate game testing agents based on the game data of the skill-based game, each game testing agent associated with a player skill level of a plurality of player skill levels for playing the skill-based game, automatically play the skill-based game using the game testing agents, determine game quality scores of the skill-based game based on game play data of the game testing agents; and output game test results for the skill-based game based on the game quality scores and the game skill level for automatically modifying the skill-based game.

Embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, are directed to computer apparatuses, and methods implemented by computers through the processing of electronic data signals.

Embodiments described herein involve computing devices, servers, electronic gaming terminals, receivers, transmitters, processors, memory, display, and networks particularly configured to implement various acts. The embodiments described herein are directed to electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components.

The gaming enhancement elements used to modify the visual representation of the game play of a skill-based game on a display screen described herein may be generated using a physical EGM. EGM may be embodied in a variety of forms, machines and devices including, for example, portable devices, such as tablets and smart phones, that can access a gaming site or a portal (which may access a plurality of gaming sites) via the Internet or other communication path (e.g., a LAN or WAN), and so on. The EGM may be located in various venues, such as a casino or an arcade. One example type of EGM is described with respect to FIG. 1.

FIG. 1 is a perspective view of an EGM 10 comprising a game controller configured to continuously monitor game play of the player to collect player game play data. The game controller may continuously detect real-time game play of the skill-based game by the player. For example, the game controller may detect and store the player's inputs to EGM 10, such as button presses, gestures, and the like. The game controller may trigger a control command to a display controller to dynamically update the rendering of the viewing area based on the player's real time or near real time game play. EGM 10 has at least one data storage device 20 to store game data of a skill-based game. The data storage device 20 may store game data of one or more primary skill-based games and one or more bonus games. In some embodiments, the one or more bonus games may be a skill-based bonus game. The display controller of EGM 10 may detect the control command from the game controller to dynamically update the rendering of the viewing area to provide a real-time or near real-time graphical animation effect displayed on the display screen representative of a visual update to one or more visible game components of the skill-based game that may be in the viewing area.

An example embodiment of EGM 10 includes a display screen 12 that may be a thin film transistor (TFT) display, a liquid crystal display (LCD), a cathode ray tube (CRT), auto stereoscopic 3D display and LED display, an OLED display, or any other type of display. An optional second display screen 14 provides game status data or other information in addition to display screen 12. Display screen 12, 14, may have 2D display capabilities or 3D display capabilities, or both. Gaming display screen 14 may provide static information, such as an advertisement for the game, the rules of the game, pay tables, pay lines, or other information, or may even display the primary skill-based game or a bonus game along with display screen 12. Alternatively, the area for display screen 14 may be a display glass for conveying information about the game. Display screen 12, 14 may also include a camera, sensor, and other hardware input devices. Display screen 12, 14 may display at least a portion of the visible game components of a skill-based game.

EGM 10 may be particularly configured to provide an interactive game environment of a skill-based game. The display screen 12, 14 may display, via a user interface, the interactive game environment and the viewing area having one or more game components in accordance with a set of game data stored in data storage device 20. The interactive game environment may be a two-dimensional (2D) interactive game environment or a three-dimensional (3D) interactive game environment, or a combination thereof.

In some embodiments, the display screen 12, 14 may be a touch sensitive display screen. The player may interact with the display screen 12, 14 using touch control such as, but not limited to, touch, hold, swipe, drag, and multi-touch controls. The player may use these interactions to play the skill-based game, manipulate the interactive game environment for easier viewing or preference, to manipulate game elements such as visible game components, or to select at least a portion of the visible game components depending on the design of the game. For example, the player may select one or more visible game components displayed by the display screen 12, 14. As another example, the player may not have to touch the display screen 12, 14 to play the skill-based game. The player may also interact with the skill-based game by pressing buttons installed on EGM 10, pressing virtual buttons displayed on display screen 12, 14, using their eye gaze, eye gestures, body movements, or a combination thereof.

A data capture device may detect game play data of the player, such as button input, gesture input and so on. The data capture device may include a panel of buttons, a camera, a sensor, or other data capture electronic hardware. In some embodiments, EGM 10 may include at least one data capture device to continuously detect the game play of a player to collect the player's game play data. The player may provide input to the EGM 10 by touching display screen 12, 14, pressing buttons, making gestures, and the like. For example, a game component may be displayed on display screen 12, 14. The player may touch the portion of display screen 12, 14 where the game component is displayed to select the game component. EGM 10 may detect the player's touch on the display screen 12, 14, which may be collected as the player's game play data. This may cause EGM 10 to trigger a response to the player's game play data, such as carrying out the skill-based game, triggering a bonus game, triggering power ups for the game, and the like.

Display screen 12, 14 may have a touch screen lamination that includes a transparent grid of conductors. Touching the screen may change the capacitance between the conductors, and thereby the X-Y location of the touch may be determined. The X-Y location of the touch may be mapped to positions of interest to detect selection thereof, for example, the game components of the skill-based game. A processor of EGM 10 may associate this X-Y location with a function to be performed. Such touch screens may be used for slot machines, for example, or other types of gaming machines. There may be an upper and lower multi-touch screen in accordance with some embodiments. One or both of display screen 12, 14 may be configured to have auto stereoscopic 3D functionality to provide 3D enhancements to the interactive game environment. The touch location positions may be 3D, for example, and mapped to at least one visible game component of the plurality of visible game components.

A coin slot 22 may accept coins or tokens in one or more denominations to generate credits within EGM 10 for playing games. An input slot 24 for an optical reader and printer receives machine readable printed tickets and outputs printed tickets for use in cashless gaming. An output slot 26 may be provided for outputting various physical indicia, such as physical tokens, receipts, bar codes, etc.

A coin tray 32 may receive coins or tokens from a hopper upon a win or upon the player cashing out. However, the EGM 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may read from various types of cards, such as smart cards, player tracking cards, magnetic strip cards, or other types of cards conveying machine readable information. The card reader reads the inserted card for player and credit information for cashless gaming. Card reader slot 34 may read a magnetic code on a conventional player tracking card, where the code uniquely identifies the player to a host system at the venue. The code may be cross-referenced by the host system to any data related to the player, and such data may affect the games offered to the player by the gaming terminal. Card reader slot 34 may also include an optical reader and printer for reading and printing coded barcodes and other information on a paper ticket. A card may also include credentials that enable the host system to access one or more accounts associated with a user. The account may be debited based on wagers by a user and credited based on a win.

The card reader slot 34 may be implemented in different ways for various embodiments. The card reader slot 34 may be an electronic reading device such as a player tracking card reader, a ticket reader, a banknote detector, a coin detector, and any other input device that can read an instrument supplied by the player for conveying a monetary amount. In the case of a tracking card, the card reader slot 34 may detect the player's stored bank and applies that to the gaming machine being played. The card reader slot 34 or reading device may be an optical reader, a magnetic reader, or other type of reader. The card reader slot 34 may have a slot provided in the gaming machine for receiving the instrument. The card reader slot 34 may also have a communication interface (or control or connect to a communication interface) to digitally transfer tokens or indicia of credits or money via various methods such as RFID, tap, smart card, credit card, loyalty card, near field communication (NFC) and so on.

An electronic device may couple (by way of a wired or wireless connection) to the EGM 10 to transfer electronic data signals for player credits and the like. For example, NFC may be used to couple to EGM 10 which may be configured with NFC enabled hardware. This may be a non-limiting example of a communication technique.

A keypad 36 may accept player input, such as a personal identification number (PIN) or any other player information. A display 38 above keypad 36 displays a menu for instructions and other information and provides visual feedback of the keys pressed.

Keypad 36 may be an input device such as a touchscreen, or dynamic digital button panel, in accordance with some embodiments.

Player control buttons 39 may include any buttons or other controllers needed to play the particular game or games offered by EGM 10 including, for example, a bet button, a repeat bet button, a spin reels (or play) button, a maximum bet button, a cash-out button, a display pay lines button, a display payout tables button, select icon buttons, game and menu navigation buttons, and any other suitable button. Buttons 39 may be replaced by a touch screen with virtual buttons.

EGM 10 may also include a digital button panel. The digital button panel may include various elements such as for example, a touch display, animated buttons, frame lights, and so on. The digital button panel may have different states, such as for example, standard play containing bet steps, bonus with feature layouts, point of sale, and so on. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. The buttons of the digital button panel may include a number of different states, such as pressable but not activated, pressed and active, inactive (not pressable), certain response or information animation, and so on. The digital button panel may receive player interaction commands, in some example embodiments.

EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

EGM 10 may also include a plurality of effects lights and frame lights. The lights may be synchronized with enhancements of the game. The EGM 10 may be configured to control color and brightness of lights. Additional custom animations (color cycle, blinking, etc.) may also be configured by EGM 10. The custom animations may be triggered by certain gaming events.

In some embodiments, EGM 10 may include output devices that may provide tactile or haptic feedback to a user of the EGM 10.

For example, a rumble motor may be installed in various portions of EGM 10, such as behind display screen 12, 14, for shaking display screen 12, 14. Game controller 44 may detect display screen 12, 14 being pressed and may send a control command to the rumble motor to generate a rumble at or near the portion of display screen 12, 14 being pressed. A game controller of EGM 10 may also cause rumble motor to generate a rumble at or near the portion of display screen 12, 14, and a user of EGM 10 may have to press said portion as part of playing the skill-based game. The game controller may compare the location where display screen 12, 14 is rumbling and the location where display screen 12, 14 is pressed by the user to collect game play data of the player.

As another example, ultrasound emitting transducers may be installed and embedded around display screen 12, 14. The ultrasound emitting transducers may emit ultrasound fields and may detect interference in the emitted ultrasound fields. The game controller of EGM 10 may send a control command to the ultrasound emitting transducers to emit an ultrasound field at a particular location relative to EGM 10. A user of EGM 10 may move their body, for example their arms and hands, to locate the ultrasound field. The user may feel a pressure sensation when the user's body interacts with the emitted ultrasound field. The game controller may detect the interruption in the emitted ultrasound field for collecting game play data of the player.

Figure 2A:
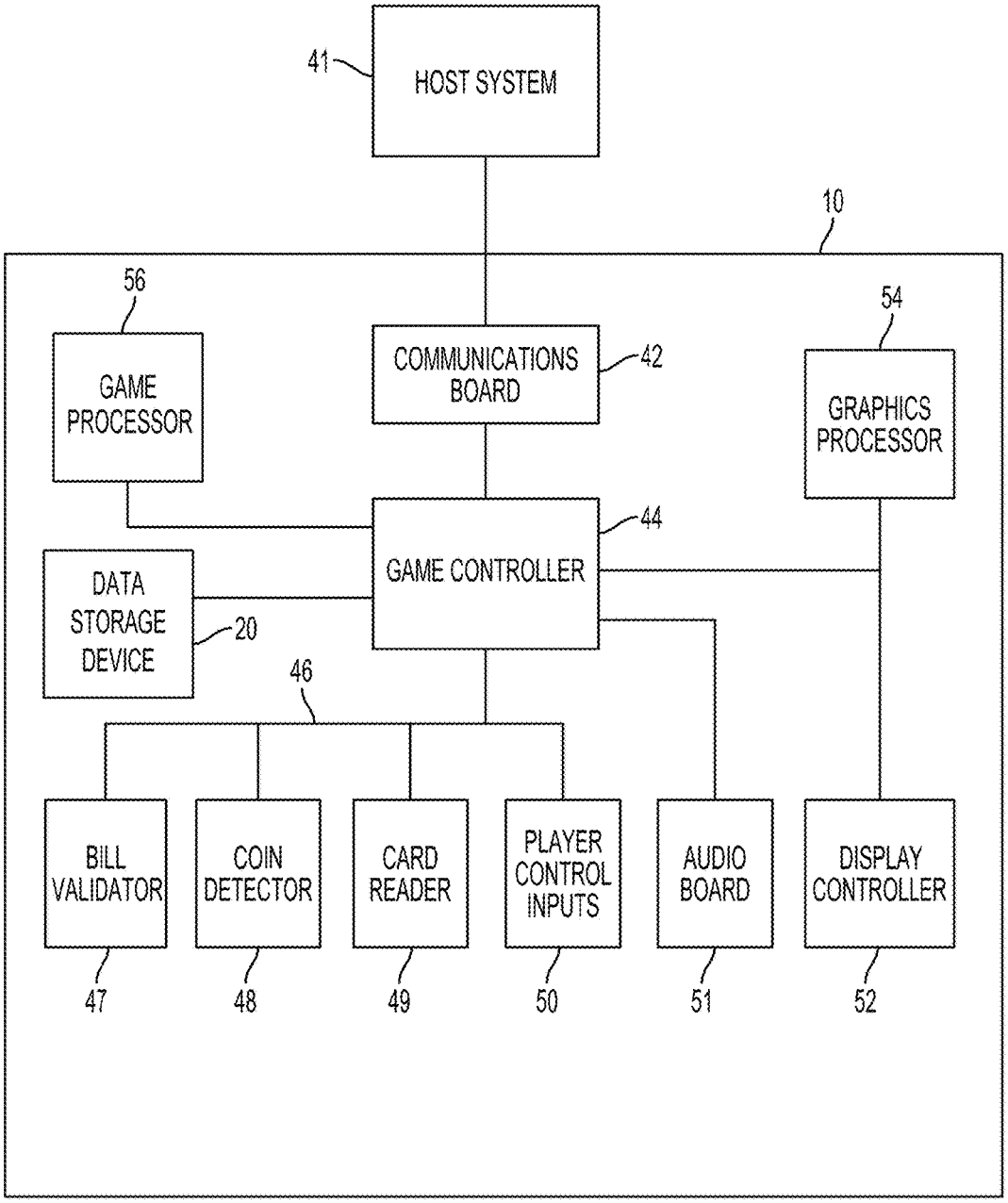
FIG. 2A is a schematic diagram of an electronic gaming machine linked to a casino host system according to some embodiments.

FIG. 2A is a block diagram of hardware components of EGM 10 according to some embodiments. EGM 10 is shown linked to the casino's host system 41 via network infrastructure. These hardware components are particularly configured to provide at least one skill-based game. These hardware components may be configured to provide at least one skill-based game and at least one bonus game.

A communications board 42 may contain circuitry for coupling the EGM 10 to network. Communications board 42 may include a network interface allowing EGM 10 to communicate with other components, to access and connect to network resources, to serve an application, to access other applications, and to perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. WMAX), SS7 signaling network, fixed line, local area network, wide area network, and others, including any combination of these. EGM 10 may communicate over a network using a suitable protocol, such as the G2S protocols.

Communications board 42 communicates, transmits and receives data using a wireless transmitter, or it may be wired to a network, such as a local area network running throughout the casino floor, for example. Communications board 42 may set up a communication link with a master controller and may buffer data between the network and a game controller 44. Communications board 42 may also communicate with a network server, such as in accordance with the G2S standard, for exchanging information to carry out embodiments described herein.

Game controller 44 includes memory and a processor for carrying out program instructions stored in the memory and for providing the information requested by the network. Game controller 44 executes game routines using game data stores in a data store accessible to the game controller 44, and cooperates with a display controller 52, a graphics processor 54 and a game processor 56 to provide skill-based games that may be modified with generated game enhancement elements.

Peripheral devices/boards communicate with the game controller 44 via a bus 46 using, for example, an RS-232 interface. Such peripherals may include a bill validator 47, a coin detector 48, a smart card reader or other type of credit card reader 49, and player control inputs 50 (such as buttons or a touch screen).

Player input or control device 50 may include the keypad, the buttons, touchscreen display, gesture tracking hardware, and data capture device as described herein. Other peripherals may be one or more cameras used for collecting player input data, or other player movement or gesture data that may be used to trigger player interaction commands. Display screen 12, 14 may be a touch sensitive display screen. Player control input device 50 may be integrated with display screen 12, 14 to detect player interaction input at the display screen 12, 14.

Game controller 44 may also control one or more devices that produce the game output including audio and video output associated with a particular game that is presented to the user. For example, audio board 51 may convert coded signals into analog signals for driving speakers.

Game controller 44 may be coupled to an electronic data store storing game data for one or more skill-based games. The game data may be for a primary skill-based game and/or a bonus game that may be a skill-based game. The game data may, for example, include a set of game instructions for each of the one or more skill-based games. The electronic data store may reside in a data storage device, e.g., a hard disk drive, a solid state drive, or the like. Such a data storage device, for example data storage device 20, may be included in EGM 10, or may reside at host system 41. In some embodiments, the electronic data store storing game data may reside in the cloud.

Card reader 49 reads cards for player and credit information for cashless gaming. Card reader 49 may read a magnetic code on a conventional player tracking card, where the code uniquely identifies the player to a host system at the venue. The code is cross-referenced by host system 41 to any data related to the player, and such data may affect the games offered to the player by the gaming terminal. Card reader 49 may also include an optical reader and printer for reading and printing coded barcodes and other information on a paper ticket. A card may also include credentials that enable host system 41 to access one or more accounts associated with a user. The account may be debited based on wagers by a user and credited based on a win.

Host system 41 may store account data for players. EGM 10 may communicate with host system 41 to update such account data, for example, based on wins and losses. In an embodiment, host system 41 stores the aforementioned game data, and EGM 10 may retrieve such game data from host system 41 during operation.

In some embodiments, the electronics on the various boards described herein may be combined onto a single board. Similarly, in some embodiments, the electronics on the various controllers and processors described herein may be integrated. For example, the processor of game controller 44 and graphics processor 54 may be a single integrated chip.

EGM 10 may be configured to generate game enhancement elements based on the game data of one or more skill-based games playable at EGM 10. EGM 10 may also be configured to compute the skill level of the player playing the skill-based game based on detecting in real time the game play of the player. The game controller may select one or more game enhancement elements to modify the visual representation of the game play. The game enhancement elements may be to a primary skill-based game, secondary skill-based game, bonus skill-based game, or combination thereof.

EGM 10 may include a player input device or a data capture device to continuously detect and monitor player interaction commands (e.g. pressing buttons on EGM 10, pressing virtual buttons displayed on display screen 12, 14, eye gaze, eye gestures, player movement, touch, gestures) to interact with the viewing area and game components displayed on the display screen 12, 14.

EGM 10 may comprise game controller 44 for controlling the skill-based game. Game controller 44 may be connected to the data storage device 20 storing game data of the skill-based game. Game controller 44 may also be connected to the display screen 12, 14.

Game controller 44 may be configured to render visual representation of game play for carrying out the skill-based game based on the game data on display screen 12, 14.

Based on the game data, game controller 44 may send a control command to display controller 52 to dynamically update the rendering of the viewing area using graphics processor 54 to render visual representation of game play of the skill-based game on display screen 12, 14.

The game components of the skill-based game may be modified as the player is playing the skill-based game. Game controller 44 may detect and collect game play data of the player as the player is playing the skill-based game. In some embodiments, game controller 44 may detect and collect a sufficient amount or a threshold amount of game play data. The game play data may be collected over a period of time. Game controller 44 may send a control command to display controller 52 to dynamically update the rendering of the viewing area using graphics processor 54. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent a visual update to the visible game components in the viewing area, the visual update based on the player's game play data.

Game controller 44 may be configured to detect real-time game play of the skill-based game by the player. Game controller 44 may detect game play of the player, for example, in the form of the player's button presses, virtual button presses, eye gaze, gestures, and the like. Upon detection of the game play of the player, game controller 44 may store the game play data in a local data storage device, such as data storage device 20, or a central data storage device.

Game controller 44 may process the game play data detected from the player to compute a player skill level. In some embodiments, the player skill level may be computed over a period of time for the detected real-time game play. In some embodiments, the player skill level may be computed repeatedly as the player plays the skill-based game.

In some embodiments, game controller 44 may compute certain skills of the player based on the detected game play of the player. For example, game controller 44 may compute the reaction time, stress management, visual and organization skills, coordination skills, audio skills, problem solving skills, and haptic/tactile skills of the player.

Game controller may compute the player skill level using one or more skill-determining factors, such as: reaction time, memory, coordination, game session length, play behavior, game behavior, game language, game location, game selection, elapsed time with one game, wagering behavior, game type, game theme, wager amounts, wager denominations, play rates, typical bonus values, game brand, prize distributions, amounts of incremental wagers, frequency of wagering, for instance the presence or absence of multiple rounds of wagering in a game, the number of rounds of wagers permitted in a game, maximum wager amounts permitted, minimum wager amounts permitted, amount of wagering, elapsed time between selected events for instance starting a new game, reaction to bonus rounds, reaction to progressive outputs, pay table features, amount of incremental wagers, frequency of wagering, elapsed time for player reaction, amount of wagering, elapsed time between wagers, frequency of player action, game rules, game complexity, ability for a player to control or have an effect on a game outcome, whether an outcome is predetermined, whether parallel wagering is provided, average game speed, average wager amounts, average wager rate, presence or frequency of bonus rounds, presence and frequency of progressive outputs, payout percentages, win rates, win percentages, loss rates, loss percentages, use of special features, frequency of use of special features, number of lines played, total amount wagered, and type of payment received.

In some embodiments, game controller 44 may compute the skill level of the player in real time or near real time as the player plays the skill-based game. In some embodiments, game controller 44 may collect a sufficient amount or a threshold amount of game play data for computing the skill level of the player. In some embodiments, game controller 44 may detect in real time game play data over a period of time for computing the skill level of the player.

Figure 3:
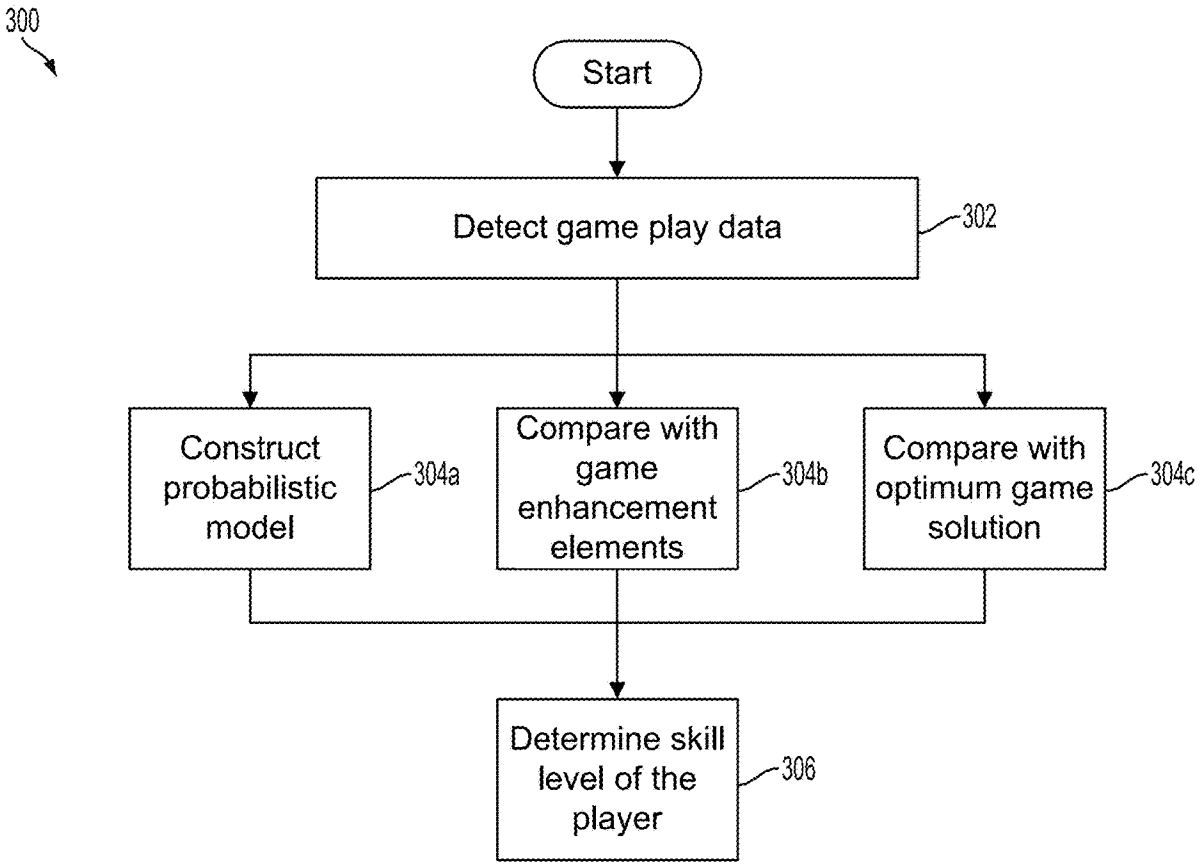
FIG. 3 is a flowchart diagram of a method implemented by a game controller to determine the skill level of a player according to some embodiments.

FIG. 3 depicts a method 300 for game controller 44 to determine the skill level of a player.

At 302, game controller 44 may detect game play data for a player playing the skill-based game. For example, game controller 44 may detect the player pressing buttons on the player control inputs 50 or pressing virtual buttons rendered and displayed on display screen 12, 14. In some embodiments, game controller 44 may transmit the detected game play data to a local or central data storage device to store the detected game play data. If the player has provided player identification, such as inserting a player tracking card into EGM 10, or inputting a user name and password, the detected game play data may be tagged with the player's identification when stored, so the detected game play data may comprise at least a portion of the historical game play data of the player.

Game controller 44 may determine the skill level of the player using at least three processes. At 304*a*, game controller 44 may construct a probabilistic model to determine how likely the player may win and/or lose the skill-based game, and the game controller 44 may compute the player's skill level based on the likelihood of the player to win or lose the skill-based game. At 304*b*, game controller 44 may use a distance metric to compare the characteristics of the game play data with the characteristics of the game enhancement elements generated by game processor 56 to determine the closest game enhancement elements. The skill level of the closest game enhancement elements to the game play data may be used by game controller 44 to compute the skill level of the player. At 304*c*, game controller 44 may compare the difference between the game play data of the player with the optimum game play of the skill-based game, and the game controller 44 may compute the skill level of the player based on said difference.

In some embodiments, game controller 44 may compute the skill level of the player using a combination of 304*a*, 304*b*, and 304*c*.

At 306, the skill level of the player may be computed by the game controller 44.

To compute the skill of the player, game controller 44 may detect the player's game play when the player is playing a skill-based game.

In some embodiments, game controller 44 may compute the skill level of the player based on the player's likelihood to win and/or lose the skill-based game. Game controller 44 may build a probabilistic model using the detected game play data and/or historic game play data of the player to determine how likely the player may win and/or lose the skill-based game.

The player's inputted game play actions and timing of said game play actions to respond to the visual representations of the game play may be detected by game controller 44 and may be stored in a local or central data storage device. The particular game play data that may be detected may depend on the game data of the skill-based game. In some embodiments, game controller 44 may detect game play data such as the player's coordination, response time, memory, outcome of the game, amount of points scored, how close the player was to winning the game, and the like. The detected game play data may be used by game controller 44 to build a probabilistic model to determine the likelihood that the player may win and/or lose the skill-based game. Game controller 44 may compute the skill level of the player by calculating the probability of a player to win and/or lose the skill-based game based on the detected game play data.

A player may be a registered player or an anonymous player, as described in greater detail herein. A registered player may be a player that may be recognized by EGM 10 and/or EGM 10 may have game play data of the registered player stored on a local data storage device, such as data storage device 20, or, if EGM 10 is connected as part of a network of gaming terminals such as a system 900 as described in FIG. 9, a central data storage device. An anonymous player may be a player that the EGM 10 does not recognize and/or does not have game play data for the anonymous player.

Figure 9:
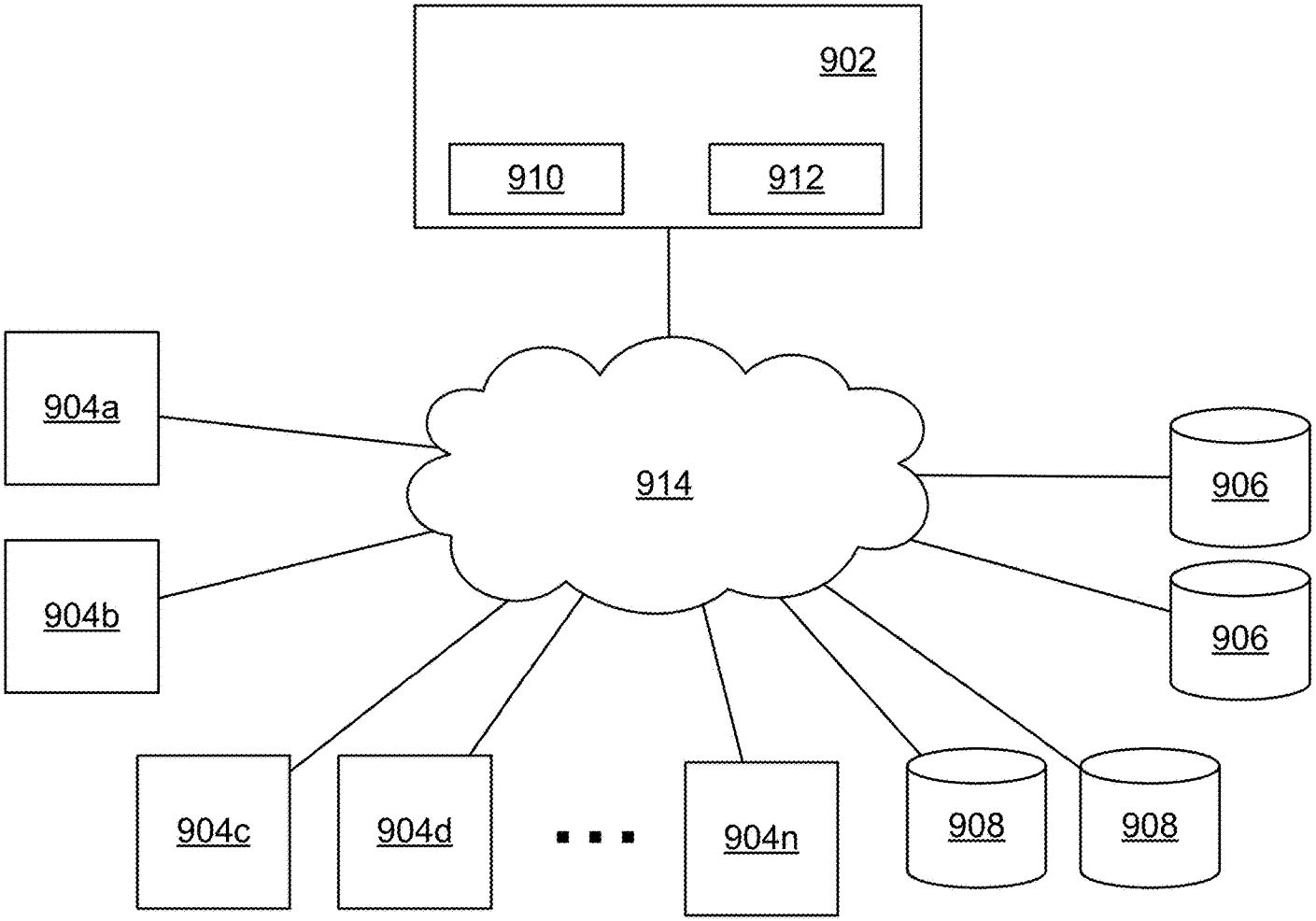
FIG. 9 is a schematic diagram of an example system of networked clients and a central server according to some embodiments.

For registered players, the number of previous wins and/or losses when playing a skill-based game may be stored in a local data storage device of EGM 10 such as data storage device 20, or if EGM 10 is part of a network of gaming terminals as depicted in FIG. 9, a central data storage device. Game controller 44 may detect the number of previous wins and/or losses when playing a skill-based game and may use this data to compute the skill level of the player. Game controller 44 may analyze the wins and losses of previous game play to derive a probability of the result of the skill-based game being played. The probabilistic model may be generated by game controller using, in part, the historical game play data to determine the probability that the player may win the skill-based game. The probability that the player may win the skill-based game may be used by game controller 44 to compute the skill level of the player.

In some embodiments, game controller 44 may compute the skill level of the player by comparing the characteristics of the game play data of the player with the characteristics of the game enhancement elements generated by game processor 56.

As described in greater detail herein, game processor 56 may generate game enhancement elements that may correspond to a plurality of skill levels of a player that may play the skill-based game. Game enhancement elements may have certain characteristics (e.g. for a poker game, game enhancement elements may be characterized as playing many hands, playing fewer hands, aggressive or passive betting, etc.), and may further be associated with a skill level. Game controller 44 may be configured to use a distance metric (e.g. nearest neighbour) to identify one or more game enhancement elements that may have characteristics most similar to the characteristics of the game play data of the player. Game controller 44 may compute the skill level of the player based on the skill level of the game enhancement elements most similar to the game play data of the player based on the distance metric. Game processor 56 may generate a plurality of game enhancement elements, with only slight differences in characteristics between the game enhancement elements. Using a distance metric to compute the skill level of the player with a plurality of game enhancement elements with slight differences may lead to an accurate computation of the skill level of the player.

In some embodiments, game controller 44 may compute the skill level of the player based on the game data of the particular skill-based game. Example skill-based games may be a skill-based maze game, a skill-based racing game, a skill-based coordination game, and a skill-based matching game.

The skill level of the player may be computed when the player is playing a skill-based game such as a skill-based maze game. Each position along a maze may be associated with one or more values for evaluating the optimum path to solve the maze.

For example, each position along a maze may be associated with a distance value. A certain position may be closer to the exit of the maze than the entrance. This position may be associated with a higher distance value than a position that is farther from the exit.

As another example, each position along a maze may be associated with a terrain type value. A certain position may be associated with a short grass terrain, which may have a positive and high-magnitude terrain value as it may correspond to ease of traversing on a short grass terrain. Another position may be associated with a swamp or mountain terrain, which may have a positive and low-magnitude value or a negative value, as it may correspond to difficulty of traversing on a swamp or mountain terrain.

As yet another example, each position along a maze may be associated with a power-up value or trap value. A certain position on the maze may comprise a power-up or a trap, or be proximate to a power-up or a trap. A position on the maze where a power-up may be located may have a positive and high-magnitude power-up value. The positions proximate to the power-up may have decreasing power-up values based on the distance from the positions to the power-up. Similarly, a position on the maze where a trap may be located may have a negative and high-magnitude trap value. The positions proximate to the trap may have decreasing trap values based on the distance from the trap to the power-up.

Game controller 44 may calculate the value of each position of the maze, for example, using the distance value, terrain type value, the power-up value, and/or trap value of each position of the maze. Game controller 44 may add these values, calculate a weighted average, or otherwise process these values to compute an optimum path for solving the maze based on the game data of the skill-based maze game. For example, where the objective of the game as defined by game data may be to solve the maze as quickly as possible, game controller 44 may calculate optimum routes. Where the objective of the game may be to solve the maze as safely as possible (i.e. avoid traps), game controller 44 may calculate a different optimum route or optional routes corresponding to a different skill level. As the player plays the maze game, game controller 44 detects the game play data of the player corresponding to the path the player is taking to solve the maze. The player's path may be compared to the optimum path as defined by the game data, such as how far the player's path deviated from the optimum path and said deviation may be used by game controller 44 to compute the player's skill level. In some embodiments, the value of each position on a maze, such as the distance value, terrain type value, power-up value, and trap value, may be generated by game processor 56. Game processor 56 may generate game enhancement elements, such as simulated player robots, as described in greater detail herein, that may play through the maze and game processor 56 score each position of the maze based on the route taken by the simulated player robot.

The skill level of the player may be computed when the player is playing a skill-based game such as a skill-based racing game. Game controller 44 may calculate the optimum racing path based upon the game data of skill-based racing game that may correspond to the movement of the vehicle, such as the characteristics of the road surface, the vehicle being driven, the curvature of the road, the surface friction of the road, and the like. Game processor 56 may generate game enhancement elements as described herein, such as a simulated player robot, which may correspond to a player with the highest skill level. Game controller 44 may process the game data and this game enhancement element corresponding to a player with the highest skill and may determine the minimum amount of time required to finish the race and/or the optimum racing path. When the player plays the game, the game play corresponding to the player's racing path may be compared to the optimum racing path as calculated by the game processor 44. Game controller 44 may compute the skill level of the player based on the difference between the player's actual racing path and the optimum racing path.

The skill level of the player may be computed when the player is playing a skill-based game such as a game that may require the player to demonstrate hand-eye coordination. For example, game controller 44 may send a control command to display controller 52 to render graphical animation effects representative of displaying targets on display screen 12, 14. A camera of the data capture device may track the player's eye gaze and game controller 44 may detect the player's eye gaze. Game controller 44 may also detect when the player touches the display screen 12, 14. Based on where the player is looking on display screen 12, 14 and where the player touches the display screen 12, 14, game controller 44 may detect the amount of time required by the player to track the targets, look at the targets, and the accuracy of the player when touching the portion of the display screen 12, 14 where the targets are rendered, which game controller 44 may use to compute the skill level of the player.

The skill level of the player may be computed when the player is playing a skill-based game such as a skill-based matching game that may require the player to move game components to align three game components of the same shape. Game controller 44 may detect the configuration of a matrix of game components rendered on display screen 12, 14 and may detect all instances where two game components of the same shape are in alignment. Game controller 44 may further detect a third game component with the same shape that may be one space away from the two game components already in alignment and calculate points that may be associated for moving the third game component to align with the two game components already in alignment. The highest points calculated may be determined by game controller 44 to be the optimum move. The player's actual move may be compared to the optimum move for game controller 44 to compute the skill level of the player.

Game controller 44 may be configured to select one or more game enhancement elements by comparing the skill level of the skill-based game and the player skill level. The selected game enhancement element may be based on the comparison of the game skill level and the player skill level. The skill level of the skill-based game may be determined as described herein, and the game enhancement elements may be generated as described herein.

Game controller 44 may modify the visual representation of the skill-based game with the one or more selected game enhancement elements. Game controller 44 may modify the visual representation of the game play using the one or more selected game enhancement elements to generate an enhanced skill-based game. Game controller 44 may send a control command to display controller 52 based on the one or more selected game enhancement elements to dynamically update the rendering of the viewing area using graphics processor 54. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent a visual update to the game components in the viewing area, the visual update based on the one or more selected game enhancement elements.

As the player is playing the enhanced skill-based game comprising game enhancement elements modifying the skill-based game, game controller 44 may detect additional real-time game play by the player of the enhanced skill-based game. The additional game play may relate to interaction with the one or more selected game enhancement elements.

Based on the additional game play data detected by game controller 44, game controller 44 may award the player. The award may include credits, free games, mega pot, small pot, progressive pot, and so on. For example, game controller 44 may trigger transfer of virtual credits to the player account of the player using the card reader and the token. The type and/or quantity of the award may be based on the additional game play and the comparison of the game skill level and the player skill level As described herein, EGM 10 may be configured to provide an interactive game environment. The interactive game environment may be a 2D or 3D interactive game environment. The interactive game environment may provide a plurality of game components or game symbols based on the game data of the skill-based game. The game data may relate to a primary skill-based game or a bonus skill-based game, or both. For example, the interactive game environment may comprise a 3D reel space that may have an active primary game matrix of a primary subset of game components. The bonus subset of game components may be different from the primary subset of game components. The player may view a viewing area of the interactive game environment, which may be a subset of the interactive game environment, on the display screen 12, 14. The interactive game environment or the viewing area may be dynamically updated based on the game play and/or the additional game play of the player in real-time or near real-time. The update to the interactive game environment or the viewing area may be a graphical animation effect displayed on the display screen 12, 14. The update to the interactive game environment or the viewing area may be triggered based on the game play or additional game play of the player. For example, the update may be triggered by the game controller 44 comparing the skill level of the player with the skill level of the skill-based game. Based on this comparison, game controller 44 may send a control command to display controller 52 to dynamically update the rendering of the display screen 12, 14 using the graphics processor 54. The interactive game environment may be updated dynamically and revealed by dynamic triggers from game content of the primary skill-based game in response to electronic data signals representative of game play data and/or additional game play data collected and processed by EGM 10.

For an interactive game environment, the EGM 10 may include a display screen 12, 14 with auto stereoscopic 3D functionality. The EGM 10 may include a touch screen display for receiving touch input data to define player interaction commands. The EGM 10 may also include at least one data capture device, for example, to further receive player input to define player interaction commands. The EGM 10 may also include several effects and frame lights.

The 3D enhancements may be an interactive game environment for additional game symbols.

In some embodiments, game controller 44 may detect and collect all game play data of the skill-based game by the player in real time or near real time. For example, game controller 44 may detect all button presses on player control inputs 50 and all presses of virtual buttons displayed on display screen 12, 14.

In some embodiments, the game enhancement element may be selected by game controller 44 based at least on the skill level of the player as computed by game controller 44. For example, if game controller 44 computes that a player playing the skill-based game has good visual skills, then game controller 44 may select a game enhancement element that may be a game enhancement element that may visually modify the skill-based game. This may engage the player playing a skill-based game on EGM 10.

In some embodiments, a plurality of game enhancement elements may be generated by EGM 10. Game controller 44 may select a game enhancement element to modify the visual representation of the game play. Game controller 44 may detect additional real time game play by the player of the enhanced skill-based game. Based on the detected additional real time game play by the player of the enhanced skill-based game, game controller 44 may select additional game enhancement elements to modify the visual representation of the game play of the enhanced skill-based game.

In some embodiments, the selected game enhancement elements and the selected additional game enhancement elements may not be identical. The selected game enhancement elements and the selected additional game enhancement elements may be varied so that a player playing a skill-based game on EGM 10 may be engaged and may not find the skill-based game repetitive.

Display controller 52 may control one or more of display screen 12, 14 using graphics processor 54 to display a viewing area that may include one or more visible game components based on the game data of a skill-based game.

Display controller 52 may, in response to detection of a control command from the game controller 44 based on the player game play data, control display screen 12, 14 using graphics processor 54. Display controller 52 may update the viewing area to trigger a graphical animation effect displayed on one or both of display screen 12, 14 representative of a visual update to the visible game components in the viewing rea. The visual update may be based on the player's game play data and/or may be based on the game enhancement elements selected by game controller 44 to modify the visual representation of the game play.

Graphics processor 54 may be configured to generate and render graphical animations corresponding to the game enhancement elements based on game data as directed by game controller 44. The game enhancement elements may involve an interactive game environment that may provide one or more game components and graphical animation effects. Graphics processor 54 may be a specialized electronic circuit designed for image processing (including 2D and 3D image processing in some examples) in order to manipulate and transform data stored in memory to accelerate the creation of images in a frame buffer for output to the display by way of display controller 52. Graphics processor 54 may redraw various game enhancement elements as they dynamically update. Graphics processor 54 may cooperate with game controller board 44 and display controller 52 to generate and render elements as described herein. Graphics processor 54 may generate an interactive game environment that may provide one or more game components, for example, a 3D reel space of a plurality of game components. The graphics processor 54 may generate graphical animation effects to represent a visual update to the game components in the viewing area, the visual update based on the player game play data, additional game play data, or any combination thereof.

Display controller 52 may require a high data transfer rate and may convert coded signals to pixel signals for the display. Display controller 52 and audio board 51 may be directly connected to parallel ports on the game controller 44. The electronics on the various boards may be combined onto a single board. Display controller 52 may control output to one or more display screen 12, 14 (e.g. an electronic touch sensitive display screen). Display controller 52 may cooperate with graphics processor 54 to render graphical animation effects on display screen 12, 14.

Display controller 52 may be configured to interact with graphics processor 54 to control the display screen 12, 14 to display a viewing area defining the interactive game environment including navigation to different views of the interactive game environment. Player control inputs 50 and the at least one data capture device may continuously detect player game play data to interact with interactive game environment. For example, the player may move a game component to a preferred position, select a game component, or manipulate the display of the game components.

In some embodiments, display controller 52 may control the display screen 12, 14 using the graphics processor 54 to display the viewing area that may have one or more game components. In response to the detection of the control command based on the player game play data or additional game play data, display controller 52 may trigger a graphical animation effect to represent a visual update to the game components in the viewing area.

As depicted in FIG. 2A, EGM 10 may comprise game processor 56. Game processor 56 may be included in the hardware of EGM 10, or may be a separate hardware device that may be attachable, for example through a USB port, to be in connection with EGM 10. Game processor 56 may be configured to generate game enhancement elements using the game data and to automatically play the skill based game using the game data and/or game play data from the player of the skill-based game to compute a skill level of the game.

In some embodiments, game processor 56 may perform an iterative process to generate game enhancement elements using the game data. A random population of preliminary game enhancement elements may be generated based on the game data of the skill-based game, each preliminary game enhancement element may be an individual of the population. During each iteration of the process, the population of preliminary game enhancement elements may be modified using programming operations that may be analogous to genetic operations. Each modified population of preliminary game enhancement elements may be a new generation of preliminary game enhancement elements. The outcome of the iterative process may be a plurality of game enhancement elements corresponding to a range of skill levels of a player playing the skill-based game.

Prior to generating game enhancement elements, game processor 56 may be pre-configured with preparatory elements.

Game processor 56 may be pre-configured with one or more sets of terminals, which may be external inputs for generating the game enhancement elements. Example terminals may include independent variables, numerical constants, zero-argument functions, and random constants. The sets of terminals pre-configured into game processor 56 may be based on the game data of the skill-based game.

Game processor 56 may be pre-configured with one or more sets of functions, which may consist of arithmetic functions, signal-processing functions, circuit construction functions, and the like. The sets of functions pre-configured into game processor 56 may be based on the game data of the skill-based game.

Game processor 56 may be pre-configured with a fitness measure for determining the fitness score of the game enhancement elements generated by game processor 56. The fitness score of a game enhancement element qualifies and quantifies the characteristics of the game enhancement element. For example, a fitness score for a game enhancement element may determine the type of skill that the game enhancement corresponds to, the level of said skill (e.g. easy, medium, or difficult), the behavioural characteristics of the game enhancement element, and the like.

Game processor 56 may be pre-configured with control parameters. An example of a control parameter is the population size of the game enhancement elements. The number of game enhancement elements may be determined based on the allowable processing time. Other control parameters may include the probabilities of performing the various types of genetic operations (e.g. crossover operation, mutation, reproduction, and architecture-altering operations) to the population of game enhancement elements, and the maximum size for programs.

Game processor 56 may be pre-configured with termination criteria. During each iteration of the iterative process, game processor 56 may check if the termination criteria have been satisfied. If it is, then the iterative process may stop. Examples of termination criteria may include a maximum number of iterations to be run as well as what may be considered a successful outcome of the iterative process. In some embodiments, game processor 56 may stop the iterative process when it has generated a plurality of game enhancement elements that may reflect a range of skill levels of a player of the skill-based game. The game enhancement elements may reflect a range of skill levels of the player may be designated as the result of the iterative process. In some embodiments, the termination criteria may be when the fitness scores of numerous successive best-of-generation individuals reaches a plateau. The single best individual may be designated as the result of the iterative process.

Figure 4:
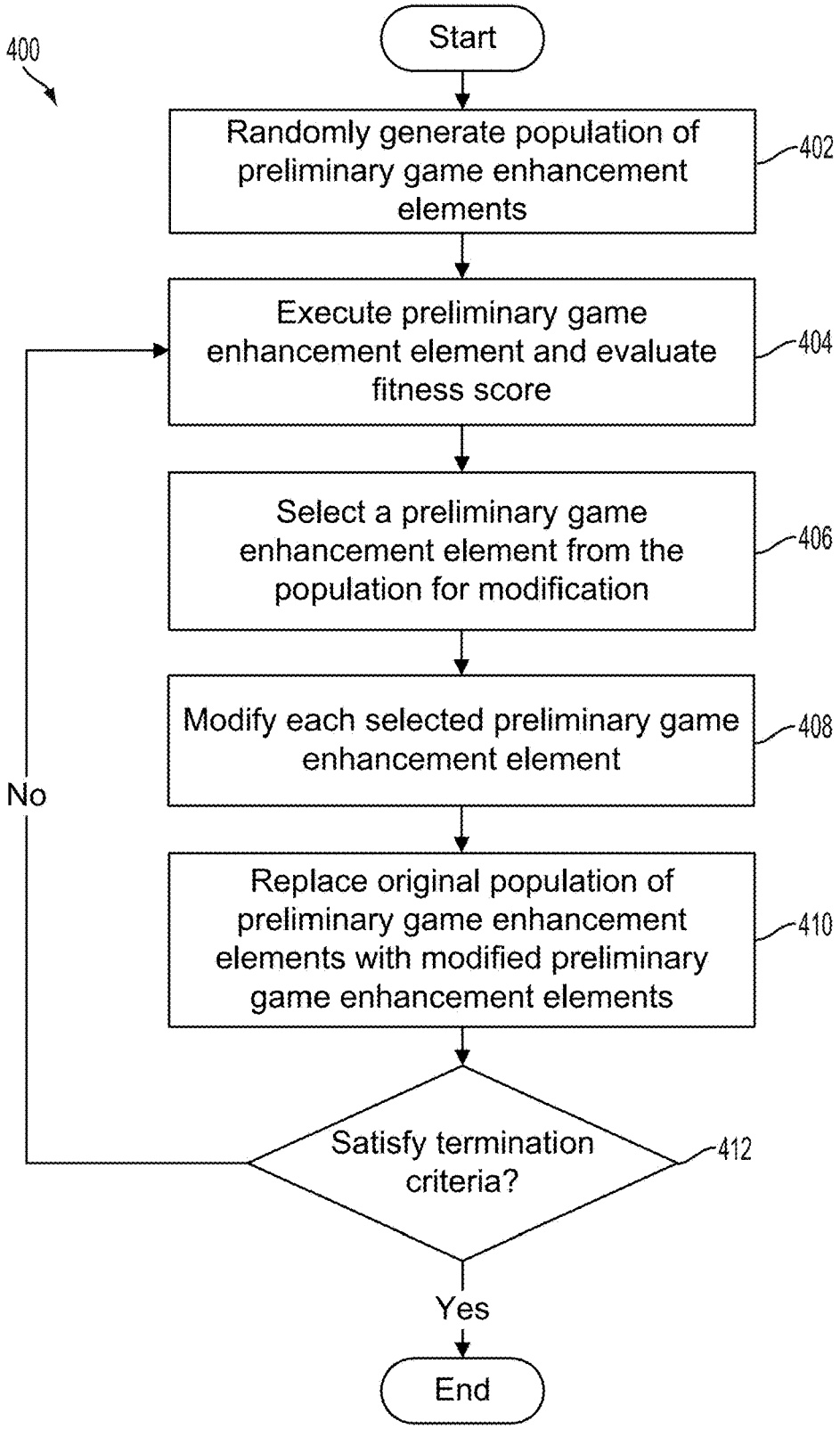
FIG. 4 is a flowchart diagram of a method implemented by a game processor to generate game enhancement elements according to some embodiments.

As depicted in FIG. 4, the game processor 56 may generate game enhancement elements using an iterative process 400.

At 402, game processor 56 may randomly generate a population of preliminary game enhancement elements based on the game data. The preliminary game enhancement elements may be composed of functions and terminals as pre-configured into game processor 56. The functions and terminals may be based on the game data of the skill-based game. The individual preliminary game elements may be recursively generated using a rooted point-labeled program tree composed of random choices of the functions and terminals. The preliminary game enhancement elements may have a size no larger than the pre-configured maximum size in some examples. The individuals in the randomly generated population of preliminary game enhancement elements may be different size, have different functionality, and different fitness.

At 404, each preliminary game enhancement element may be executed and the fitness score may be evaluated. The fitness score of a preliminary game enhancement element may be measured in many different ways, including, for example, in terms of the amount of error between its output and the desired output, the amount of time required to bring a system to a desired target state, the accuracy of the program in recognizing patterns or classifying objects into classes, the payoff that a game-playing program produces, or the compliance of a complex structure with user-specified design criteria. The execution of the preliminary game enhancement elements may returns one or more fitness scores. In some embodiments, the fitness score of the preliminary game enhancement elements may describe the type of skill associated with the preliminary game enhancement elements or the skill level of the preliminary game enhancement element.

Since the population of preliminary game enhancement elements may be generated randomly, as described in 402, the individuals of the population of preliminary game enhancement elements may have poor fitness scores. However, some of the individuals of the population of preliminary game enhancement elements may have a higher fitness score than others.

At 406, the population of preliminary game enhancement elements may be modified. An individual preliminary game enhancement element from the population of preliminary game enhancement elements may be selected for modification. The selection of said individual preliminary game enhancement element may be based at least in part on the fitness score of the preliminary game enhancement elements. The selection of the individual preliminary game enhancement element may be a probabilistic process. In this probabilistic selection process, better preliminary game enhancement elements may be favored over inferior preliminary game enhancement elements. That is, a preliminary game enhancement element with a higher fitness score may be selected over a preliminary game enhancement element with a lower fitness score. However, the best preliminary game enhancement element in the population may not necessarily be selected and the worst preliminary game enhancement element in the population may not necessarily be passed over.

In some embodiments, the number of times an individual preliminary game enhancement element may be selected may be the same number as the number of individuals in the population of preliminary game enhancement element.

At 408, the selected preliminary game enhancement element may be modified. The modification of the selected preliminary game enhancement element may be a genetic operation, which may include crossover (sexual recombination), mutation, reproduction, and architecture-altering operations. The preliminary game enhancement element may be modified to be a modified preliminary game enhancement element.

In the crossover, or sexual recombination operation, two parental preliminary game enhancement elements may be probabilistically selected from the population based on fitness. The two preliminary game enhancement elements participating in crossover may be of different sizes, shapes, and/or fitness. A crossover point may be randomly chosen in the first parent and a crossover point may be randomly chosen in the second parent. Then, the subtree rooted at the crossover point of the first, or receiving, parent may be deleted and replaced by the subtree from the second, or contributing, parent. Crossover may be the predominant operation in the iterative process 400 and may be configured to be performed with a high probability.

In the mutation operation, a single preliminary game enhancement element may be probabilistically selected from the population based on fitness. A mutation point is randomly chosen, the subtree rooted at that point is deleted, and a new subtree is grown there using the same random growth process that was used to generate the initial population of preliminary game enhancement element. This asexual mutation operation may typically be performed sparingly in the iterative process 400.

The reproduction operation copies a single individual, probabilistically selected based on fitness, into the next generation of the population. This reproduction operation may typically be performed sparingly in the iterative process 400.

The iterative process 400 may use architecture-altering operations to automatically determine program architecture in a manner that may parallel gene duplication in nature and the related operation of gene deletion in nature. Architecture-altering operations may provide a way, dynamically during the run of iterative process 400, to add and delete subroutines and other types of branches to preliminary game enhancement elements to add and delete arguments possessed by the subroutines and other types of branches. These architecture-altering operation may create an architecturally diverse population containing programs with different numbers of subroutines, arguments, iterations, loops, recursions, and memory and, also, different hierarchical arrangements of these elements. This architecture-altering operation may typically be performed sparingly in the iterative process 400.

At 410, after the modification of the population of preliminary game enhancement element, the modified preliminary game enhancement elements may replace the initial population of preliminary game enhancement elements.

At 412, game processor 56 may evaluate whether the modified preliminary game enhancement elements satisfies the termination criteria. If the terminal criteria are satisfied, then the iterative process may stop. If the termination criteria are not satisfied, the iterative process 400 may repeat at 404, evaluating the new population of modified preliminary game enhancement elements for their fitness score, and then modifying the population of modified preliminary game enhancement elements as described herein. In some embodiments, the iterative process 400 may repeat many times.

In some embodiments, the result of the iterative process 400 may be a plurality of game enhancement elements that may correspond to multiple skill levels of a player playing the skill-based game. A game enhancement element within the generated set of game enhancement elements may correspond to a skill level within a range of skill levels.

In some embodiments, the result of the iterative process 400 may be one preliminary game enhancement element that may be correspond to an optimal or best skill level of a player playing the skill-based game.

In some embodiments, game processor 56 may be configured to execute a symbiotic bid-based process for generating game enhancement elements using the game data.

In some embodiments, game processor 56 may have a reporting function that may generate reports relating to the characteristics and performance of the generated game enhancement elements. For example, in the context of a poker game, for each generated game enhancement element, game processor 56 may generate a report on the types of opening hands that the generated game enhancement element plays, the aggressiveness of placing bets, the magnitude of bets, the bet frequency, and the like.

In some embodiments, game processor 56 may generate game enhancement elements in real time or near real time as the player is playing the skill-based game.

Game processor 56 may be configured to compute the skill level of the skill-based game.

In some embodiments, the game data of the skill-based game may be tagged, such that the game data may define base functionality of the game and additional add-ons, bonus features, etc. may be enabled. The game processor 56 may process the game data and the tags on the game data stored in the data storage device 20 and may determine the skill level of the skill-based game.

In some embodiments, the game processor 56 may also review the historical game play data that may be stored on a game play data storage device 20 on EGM 10. Game processor 56 may determine the skill level of the players based on the features of the skill-based game that may be triggered and used by the player. Based on the evaluation of the skill of the player, game processor 56 may determine the skill level of the skill-based game.

In some embodiments, the game enhancement elements generated by game processor 56 may determine the skill level of the skill-based game. The generated game enhancement elements may be based on the game data of the skill-based game. The generated game enhancement elements may have a fitness score that may be associated with the skill level of the game. For example, a certain number of game enhancement elements may be associated with making the skill-based game easier, and a fewer number of game enhancement elements may be associated with making the skill-based game more difficult. Game processor 56 may process the game enhancement elements and may compute the skill-based game has a relatively high skill level.

Figure 2B:
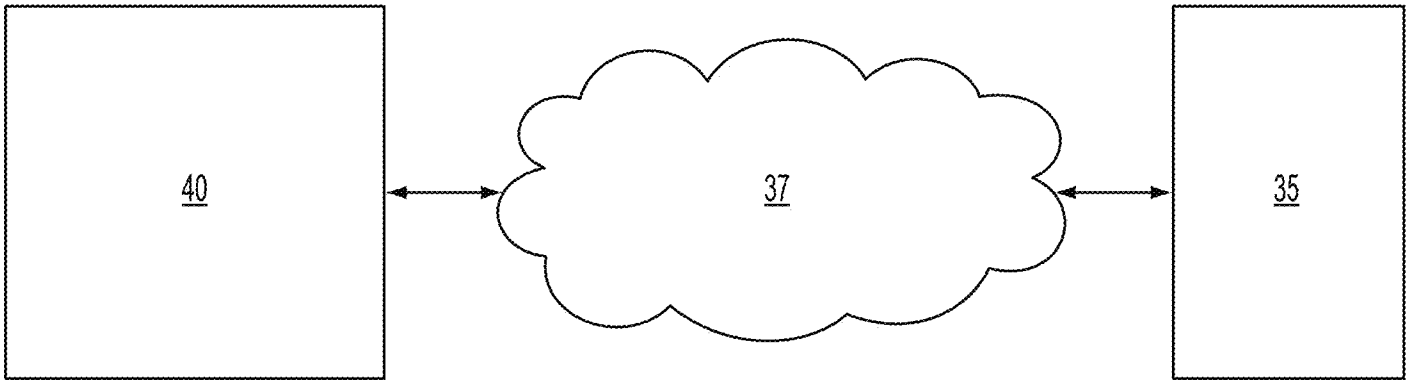
FIG. 2B is a schematic diagram of an exemplary online implementation of a computer system and online gaming system according to some embodiments.

FIG. 2B illustrates an online implementation of a gaming system that may render visual representation of game play for carrying out a skill-based game, generate game enhancement elements based on the game data of the skill-based game, compute a player skill level, select game enhancement elements based on the player skill level, and modify the visual representation of the game play using the selected game enhancement elements. The game play of the player may be detected in real time or near-real time. The game enhancement elements may be generated The gaming system may be an online gaming device (which may be an example implementation of an EGM). As depicted, the gaming system includes a gaming server 40 and a gaming device 35 connected via network 37.

In some embodiments, gaming server 40 and gaming device 35 cooperate to implement the functionality of EGM 10, described above. Aspects and technical features of EGM 10 may be implemented in part at gaming device 35, and in part at gaming server 40.

Gaming server 40 may be configured to enable online gaming, and may include game data and game logic to implement the games, generate game enhancement elements, select game enhancement elements, and modify the visual representation of the game play with the selected game enhancement elements as disclosed herein. For example, gaming server 40 may include a player input engine configured to process player input and respond according to game rules. Gaming server 40 may include a graphics engine configured to generate the interactive game environment as disclosed herein. In some embodiments, gaming server 40 may provide rendering instructions and graphics data to gaming device 35 so that graphics may be rendered at gaming device 35.

Gaming server 40 may also include a movement recognition engine that may be used to process and interpret collected player game play data, such as button presses, virtual button presses, eye gaze data, player eye gesture data, and player movement data, to transform the data into data defining manipulations and player interaction commands.

Network 37 may be any network (or multiple networks) capable of carrying data including the Internet, Ethernet, POTS line, PSTN, ISDN, DSL, coaxial cable, fiber optics, satellite, mobile, wireless (e.g. WMAX), SS7 signaling network, fixed line, local area network, wide area network, and others, including any combination of these.

Gaming device 35 may be particularly configured with hardware and software to interact with gaming server 40 via network 37 to implement gaming functionality and render 2D or 3D enhancements, as described herein. For simplicity, only one gaming device 35 is shown but an electronic gaming system may include one or more gaming devices 35 operable by different players. Gaming device 35 may be implemented using one or more processors and one or more data stores configured with database(s) or file system(s), or using multiple devices or groups of storage devices distributed over a wide geographic area and connected via a network (which may be referred to as "cloud computing"). Aspects and technical features or EGM 10 may be implemented using gaming device 35.

Gaming device 35 may reside on any networked computing device, such as a personal computer, workstation, server, portable computer, mobile device, personal digital assistant, laptop, tablet, smart phone, an interactive television, video display terminals, gaming consoles, electronic reading device, and portable electronic devices or a combination of these.

Gaming device 35 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Gaming device 35 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Gaming device 35 is operable to register and authenticate users (using a login, unique identifier, and password for example) prior to providing access to applications, a local network, network resources, other networks and network security devices. The computing device may serve one user or multiple users.

Gaming device 35 may include one or more input devices (e.g. player control inputs 50), such as a keyboard, mouse, camera, touch screen and a microphone, and may also include one or more output devices such as a display screen (with 3D capabilities) and a speaker. Gaming device 35 has a network interface in order to communicate with other components, to access and connect to network resources, to serve an application and other applications, and perform other computing applications.

Gaming device 35 connects to gaming server 40 by way of network 37 to access technical 2D and 3D enhancements to games as described herein. Multiple gaming devices 35 may connect to gaming server 40, each gaming device 35 operated by a respective player.

Gaming device 35 may be configured to connect to one or more other gaming devices through, for example, network 37. In some embodiments, the gaming server 40 may be utilized to coordinate the gaming devices 35. Where gaming devices 35 may be utilized to facilitate the playing of a same game, such as a skill-based game, wherein the skill-based game includes at interaction between activities performed by the players on the gaming devices 35, various elements of information may be communicated across network 37 and/or server 40. For example, the elements of information may include player eye gaze data, player eye gesture data, player movement data, and/or the viewing area displayed on the gaming device 35. This information may be used by each of the gaming devices 35 to provide and/or display interfaces that take into consideration the received data from another gaming device 35. The gaming devices 35 may be configured for cooperative and/or competitive play (or a combination thereof) between the players in relation to various game objectives, events, and/or triggers.

Figure 2C:
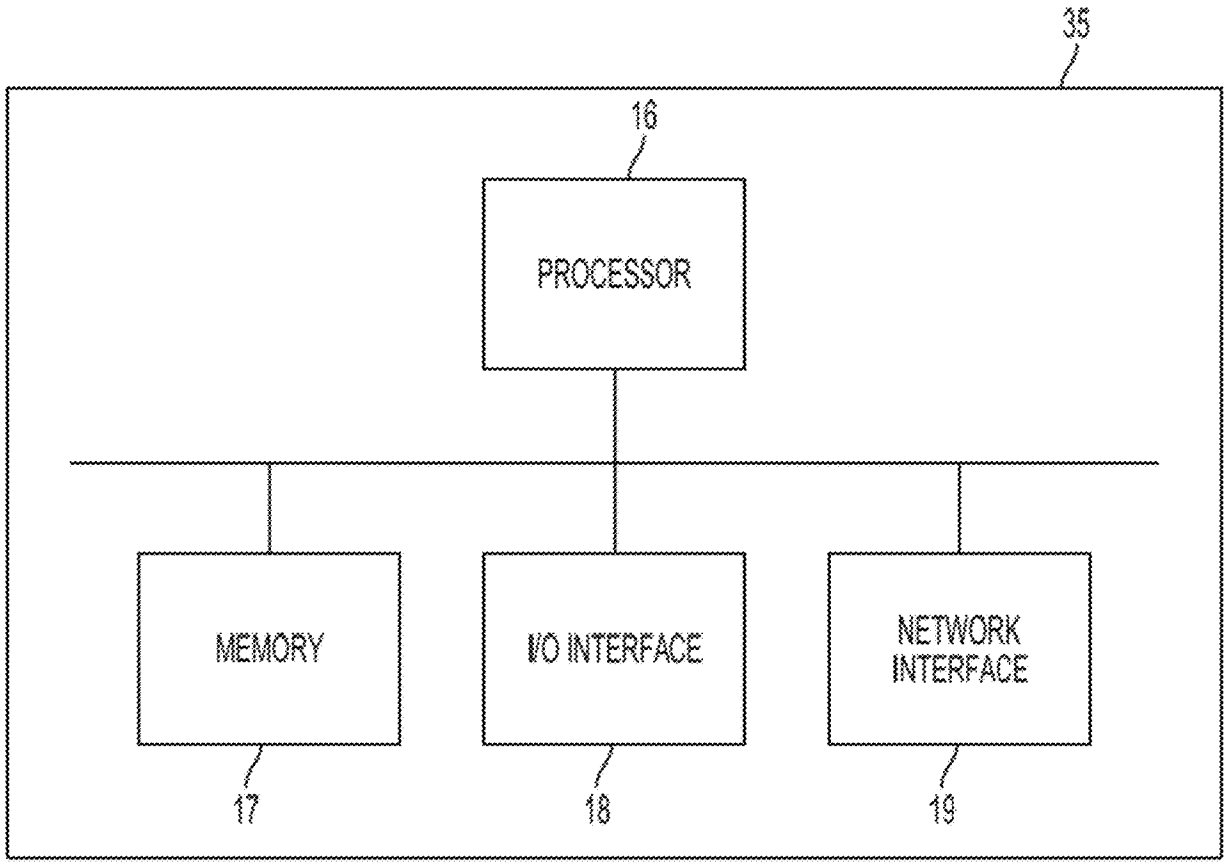
FIG. 2C is a schematic diagram of the computer system of FIG. 2B according to some embodiments.

FIG. 2C a block diagram depicting hardware components of gaming device 35 of FIG. 2B.

As depicted, gaming device 35 includes at least one processor 16, memory or data store 17, at least one I/O interface 18, and at least one network interface 19.

Processor 16 may be any type of processor, such as, for example, any type of general-purpose microprocessor or microcontroller, a DSP processor, an integrated circuit, an FPGA, a reconfigurable processor, a PROM, or any combination thereof. Processor 16 may also be a graphics processor adapted to generate and render graphic animations effects, as described above.

Memory 17 may be any type of electronic memory that is located either internally or externally such as, for example, RAM, ROM, CDROM, electro-optical memory, magneto-optical memory, EPROM, and EEPROM, FRAM or the like.

I/O interfaces 18 enables gaming device 35 to interconnect with input and output devices, e.g., peripheral devices or external storage devices. Such peripheral devices may include one or more input devices, such as a keyboard, mouse, camera, touch screen and a microphone, and may also include one or more output devices such as a display screen (with three dimensional capabilities) and a speaker.

Network interfaces 19 enable gaming device 35 to communicate with other networks, to access and connect to network resources, to serve an application, to access other applications, and perform other computing applications by connecting to a network such as network 37.

In some embodiments, gaming server 40 may include hardware components similar to those shown in FIG. 2C.

In some embodiments, gaming device 35 and/or gaming server 40 may be implemented using multiple devices, multiple databases, or multiple storage devices distributed over a wide geographic area and connected via a network (which may be referred to as "cloud computing"). In an embodiment, gaming device 35 and gaming server 40 may be integrated as a single system or a single device.

Figure 2D:
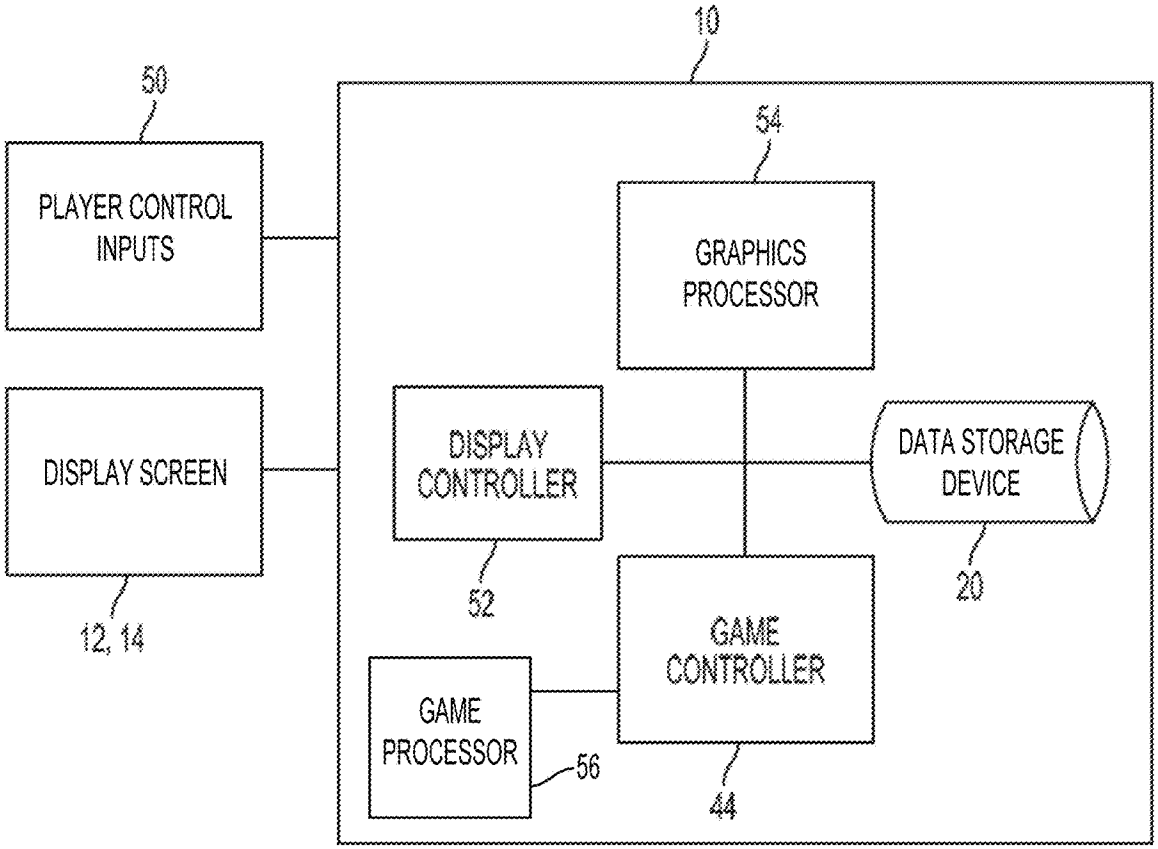
FIG. 2D is a schematic diagram of an example electronic gaming machine according to some embodiments.

FIG. 2D is a schematic of another example EGM 10 according to some embodiments. Various components of EGM 10 shown in this example are described herein in relation to FIG. 1 and FIG. 2B. As shown, EGM 10 may couple to player control inputs 50 (which may also include a card reader) and display screen 12, 14 to render and display the interactive game environment and game components of the skill-based game and receive player interactive control commands. EGM 10 may also include display controller 52 and graphics processor 54 to control graphical animation effects rendered on display screen 12, 14 in response to the interactive control commands. EGM 10 may also include game controller 44 for rendering visual representation of game play for carrying out the skill-based game, detect real time or near real time game play of the player, compute the skill level of the player, select game enhancements for modify the visual representation of the skill-based game, and awarding the player based on the player's game play for the enhanced skill-based game. EGM 10 may also include data storage device 20 for storing game data. EGM 10 may also include game processor 56 for generating game enhancement elements as described herein.

Figure 2E:
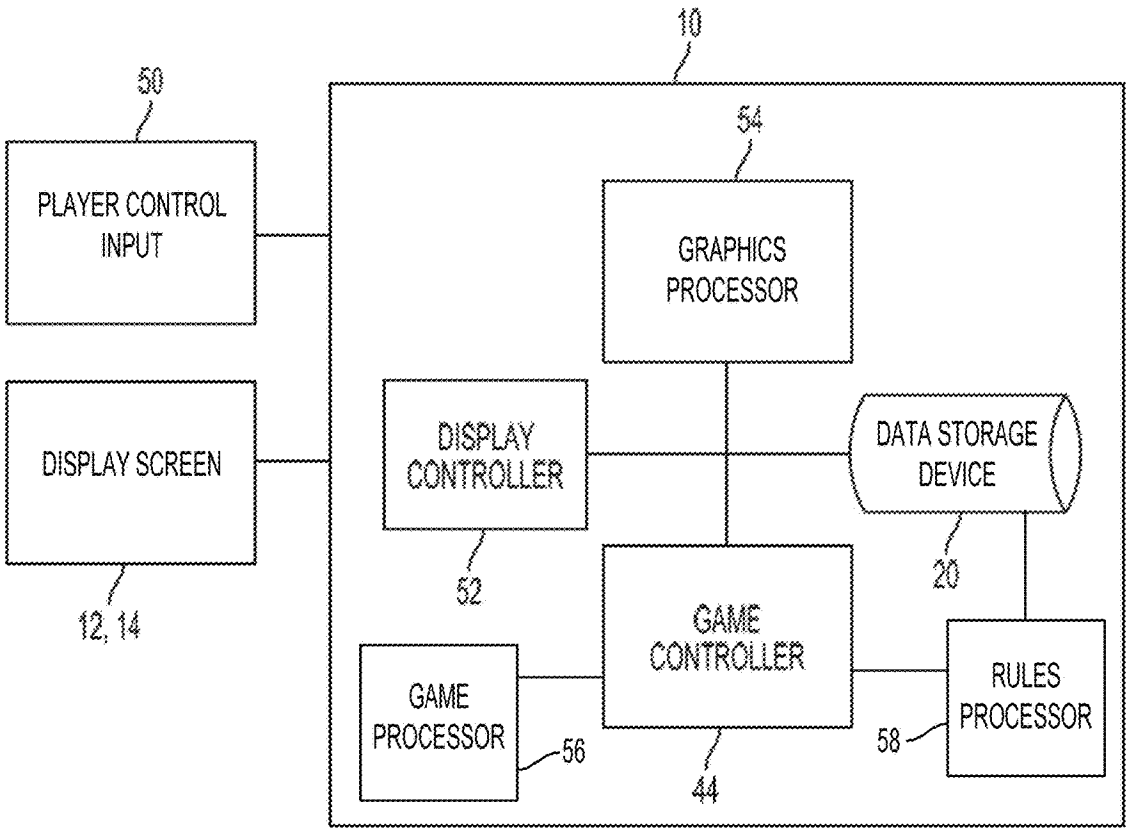
FIG. 2E is a schematic diagram of an example electronic gaming machine comprising a rules processor according to some embodiments.

FIG. 2E is a schematic of another example EGM 10 comprising a rules processor 58. Rules processor 58 may be configured to enable portions of the game data and disable other portions of the game data as described in greater detail herein.

Figure 5:
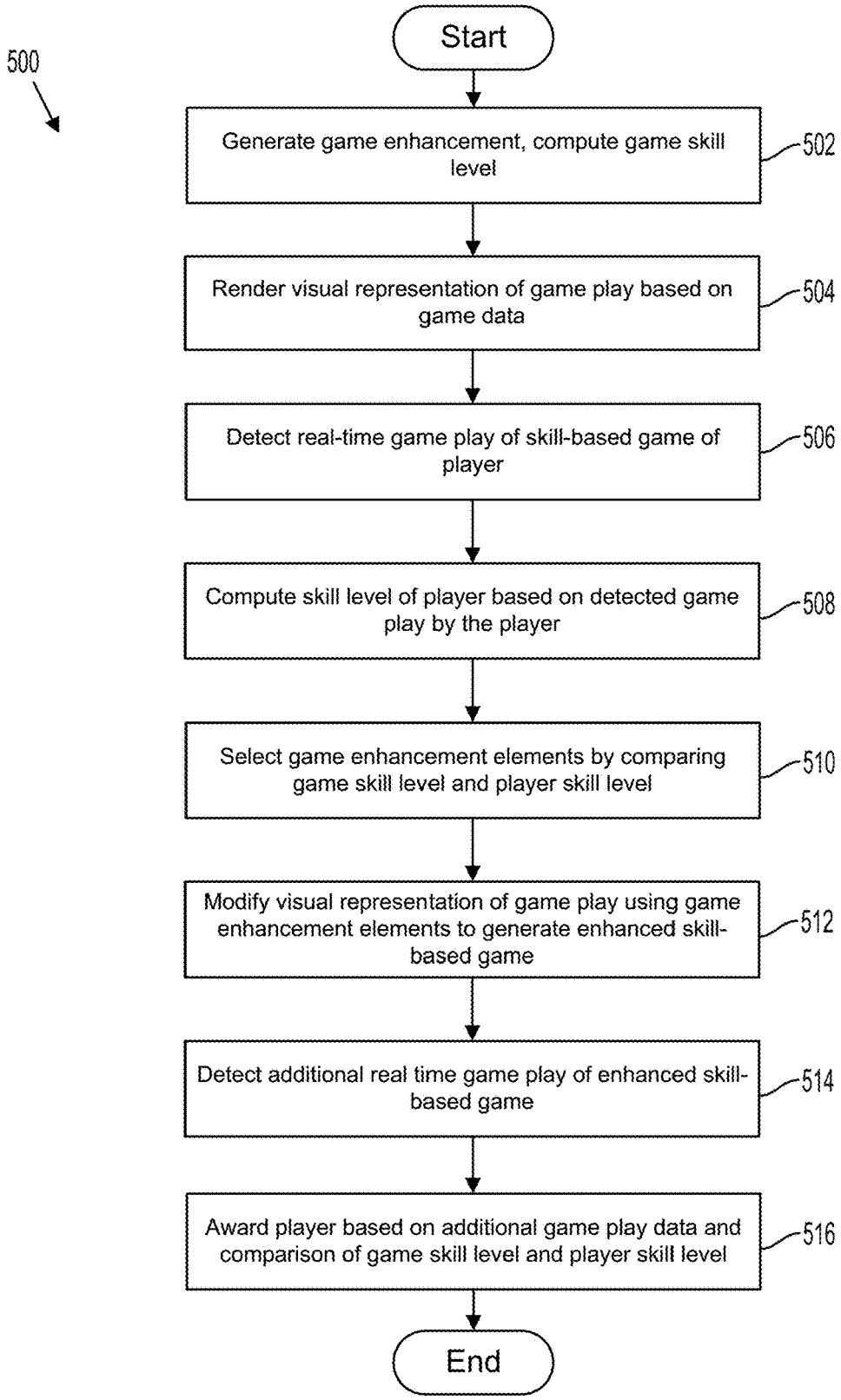
FIG. 5 is a flowchart diagram of a method implemented by an electronic gaming machine according to some embodiments.

FIG. 5 is a flowchart of a method 500 implemented by EGM 10 using various components of EGM 10. For simplicity of illustration, method 500 will be described with reference to FIG. 2A and EGM 10, but it may be implemented using gaming device 35, game server 40 or a combination thereof.

EGM 10 may include data storage device 20 for storing game data of the skill-based game.

EGM 10 may include a card reader to receive a token for player account of a player to initiate the skill-based game.

EGM 10 may include display screen 12, 14 for providing a visual rendering for the skill-based game.

EGM 10 may include game processor 56 configured to automatically generate game enhancement elements using the game data and to automatically play the skill-based game using the game data to compute a game skill level.

EGM 10 may include game controller 44 connected to the data storage device 20 and display screen 12, 14 to control the skill-based game. The game controller 44 may be configured to render visual representation of game play for carrying out the skill-based game based on the game data, detect real-time game play of the skill-based game by the player, compute a player skill level based on the detected game play by the player, the player skill level over a period of time for the detected real-time game play, select one or more game enhancement elements by comparing the game skill level and the player skill level, each game enhancement element linked to the comparison of the game skill level and the player skill level, modify the visual representation of the game play using the one or more selected game enhancement elements to generate an enhanced skill-based game, detect additional real-time game play by the player of the enhanced skill-based game, the additional game play involving interaction with the one or more generated game enhancement elements, and award the player based on the additional game play and the comparison of the game skill level and the player skill level by triggering transfer of virtual credits to the player account of the player using the card reader and the token.

At 502, game processor 56 may automatically generate game enhancement elements using the game data and to automatically play the skill-based game to compute a game skill level as described herein.

At 504, game controller 44 may be configured to render visual representation of game play for carrying out the skill-based game. Based on the game data, game controller 44 may send a control command to display controller 52 to dynamically update the rendering of the viewing area using graphics processor 54 to render visual representation of game play of the skill-based game on display screen 12, 14.

At 506, game controller 44 may detect game play in real-time or near real-time of the skill-based game by a player. For example, game controller 44 may detect button presses from player control inputs 50 or presses of virtual buttons displayed on display screen 12, 14.

At 508, game controller 44 may compute the skill level of the player using the detected game play data of the player, and, in some examples, the historical game play data of the player. The player skill level may be computed over a period of time for the detected game play. In some embodiments, the skill level of the player may be different for different games and/or different periods of time. For example, game controller 44 may compute that the player playing the skill-based game may have a low, medium, or high skill level. In some embodiments, based on the particular game data for the skill-based game, game controller 44 may compute the particular playing style or playing behavior of the player. For example, when the player is playing a game of poker on EGM 10, based on the player's detected real-time or near real-time game play, game controller 44 may determine that the player is a conservative or aggressive player, the player's tendency to bluff, the player's tendency to call a bluff or be susceptible to a bluff, and the like.

At 510, game controller 44 may select one or more game enhancement elements by comparing the game skill level and the player skill level. Game controller 44 may select each game enhancement element based on the comparison of the game skill level and the player skill level. For example, game processor 56 may determine that the skill-based game is a low-skill game, and game controller 44 may determine that the player is a highly skilled player for the skill-based game. Game controller 44 may compare the skill level of the player (high) and the skill level of the game (low) and may select game enhancement elements that may increase the difficulty of the skill-based game. This may engage the player while the player is playing a skill-based game.

At 512, game controller 44 may modify the visual representation of the game play using the one or more selected game enhancement elements to generate an enhanced skill-based game. Game controller 44 may send a control command to display controller 52 based on the one or more selected game enhancement elements to dynamically update the rendering of the viewing area using graphics processor 54. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent a visual update to the visible game components in the viewing area, the visual update based on the one or more selected game enhancement elements. For example, game controller 44 may send a control command to display controller 52 to display graphical animations representative of power-ups on display screen 12, 14 that may affect the game play of a skill-based game.

At 514, game controller 44 may detect additional real time or near real time game play of the player of the enhanced skill-based game. The additional game play of the player may involve interaction with one or more generated game enhancement elements. For example, if a graphical animation representative of a power-up is displayed on display screen 12, 14, game controller 44 may detect that the player pressed the location on display screen 12, 14 where the power-up is displayed, which game controller 44 may determine that the player is pressing the power-up.

At 516, game controller 44 may award the player based on the additional game play data and the comparison of the game skill level and the player skill level. For example, game controller 44 may modify the visual representation of the game play of the skill-based game with a game enhancement element such that the game play of the skill-based game is more difficult for the player. The player may play the more difficult enhanced skill-based game comprising the game enhancement element. Based on the player's success when playing the more difficult enhanced skill-based game, game controller 44 may award the player, such as with more credits than would normally be awarded for successfully playing the skill-based game at an easier skill level.

In some embodiments, the game enhancement elements generated by game processor 56 may be used by game controller 44 to modify the visual representation of the game play of the skill-based game. Game controller 44 may modify the visual representation of the game play of the skill-based game by adding, removing, and/or changing game components.

For example, a player may be playing a skill-based matching game, the game data of this game may ask a player to consecutively select, from a matrix of game tiles depicting a certain shape, game tiles depicting the same shape rendered on display screen 12, 14. Based on the game data, game processor 56 may compute the skill level of the skill-based matching game initially presented to the player. For example, game processor 56 may compute that the skill level of the skill-based matching game may be a simple skill-based game. Game processor 56 may generate game enhancement elements based on this game data. The generated game enhancement elements may reflect a range of skill levels of a player playing the skill-based game. The generated game enhancement elements may correspond to a skilled player or an unskilled player of the skill-based game such that when the game enhancement elements are included to modify the skill-based game to the enhanced skill-based game, the difficulty level of the enhanced skill-based game may be raised or lowered. For example, for the skill-based matching game, game processor 56 may generate a plurality of shapes for depicting on game tiles that may be simple and common shapes or complex shapes. Complex shapes may be shapes with a plurality of sides or a shape with more dimensionality than the shapes initially displayed to the player on display screen 12, 14. As another example, the generated game enhancement elements may relate to dynamically modifying the shape and size of the matrix in which the game tiles are displayed. This dynamic modification may be generated in real time or near real time.

Figure 6A:
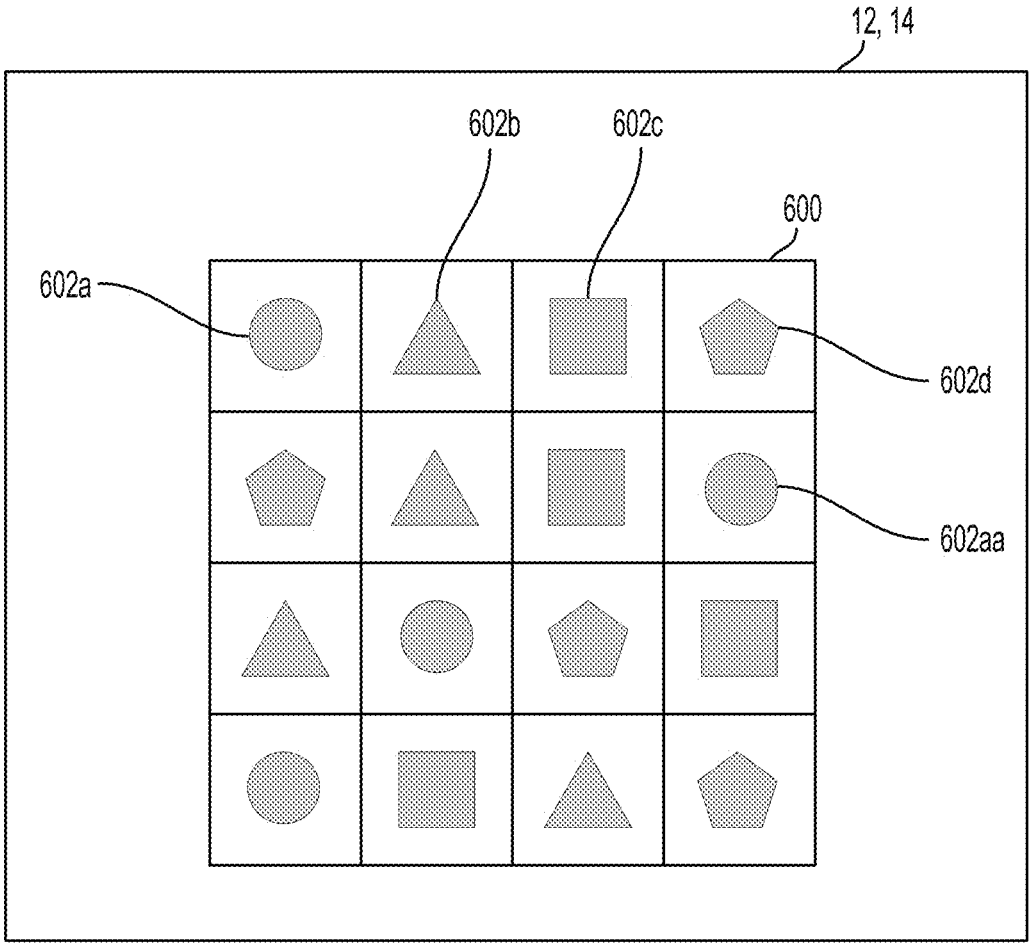
FIG. 6A to FIG. 6C schematic diagrams illustrating a skill-based matching game rendered by an electronic gaming machine according to some embodiments.

Game controller 44 may send a control command to display controller 52 to dynamically update the rendering of the viewing area using graphics processor 54 to render visual representation of the skill based matching game. As depicted in FIG. 6A, the game components of a skill-based game may comprise a matrix 600 and a plurality of game tiles, such as game tiles 602*a*, 602*b*, 602*c*, 602*d*, of the skill-based game on display screen 12, 14. When the player plays the skill-based matching game, matrix 600 comprising game tiles 602*a*, 602*b*, 602*c*, and 602*d* may be initially rendered on display screen 12, 14. A player may be prompted to press a first location on the display screen 12, 14 corresponding to a first game tile 602, such as game tile 602*a*, and then press a second location on the display screen 12, 14 corresponding to a second game tile 602, such as game tile 602*aa*. Game controller 44 may detect the game play of the player in real time or near real time, such as the player pressing the locations on the display screen 12, 14, and may determine that the player pressed the locations on the display screen 12, 14 corresponding to game tiles 602 with a matching shape, such as game tiles 602*a* and 602*aa*. Upon detection of the virtual button presses and computation that the game tiles 602*a* and 602*aa* are matching, game controller 44 may send a control command to display controller 52. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 to indicate that the player selected matching game tiles. For example, display controller 52 may generate a graphical animation effect corresponding to highlighting the selected game tiles 602*a* and 602*aa*, enlarging the selected game tiles 602*a* and 602*aa*, or generating a text and/or graphic indicator that the player correctly matched game components 602*a* and 602*aa*. These graphical animation effects may represent a visual update to the visible game components in the viewing area, the visual update based on the player's game play data, in particular the player's pressing of the virtual buttons on display screen 12, 14.

As the player plays the matching game as depicted in FIG. 6A, game controller 44 may compute a player skill level based on the detected game play of the player and, in some embodiments, the historical game play data of the player and/or the game data. For example, a player playing the game of FIG. 6A may be proficient at matching the game tiles 602 initially rendered by display controller 52 on display screen 12, 14. The player may be consistently and correctly matching the game tiles, or make infrequent mistakes. Game controller 44 may compute that the player is a skilled player at the matching game. Game controller 44 may compare the skill level of the game as computed by game processor 56 and the skill level of the player as assessed by game controller 44, and may select one or more game enhancement elements generated by game processor 56. If a player is proficient at playing the skill-based game, game controller 44 may select one or more game enhancement elements for modifying the skill-based game such that the enhanced skill-based game may be more difficult than the skill-based game.

Game controller 44 may modify the visual representation of the skill-based game with the one or more selected game enhancement elements. Game controller 44 may modify the visual representation of the game play using the one or more selected game enhancement elements to generate an enhanced skill-based game. Game controller 44 may send a control command to display controller 52 based on the one or more selected game enhancement elements to dynamically update the rendering of the viewing area using graphics processor 54. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent a visual update to the visible game components in the viewing area, the visual update based on the one or more selected game enhancement elements.

Figure 6B:
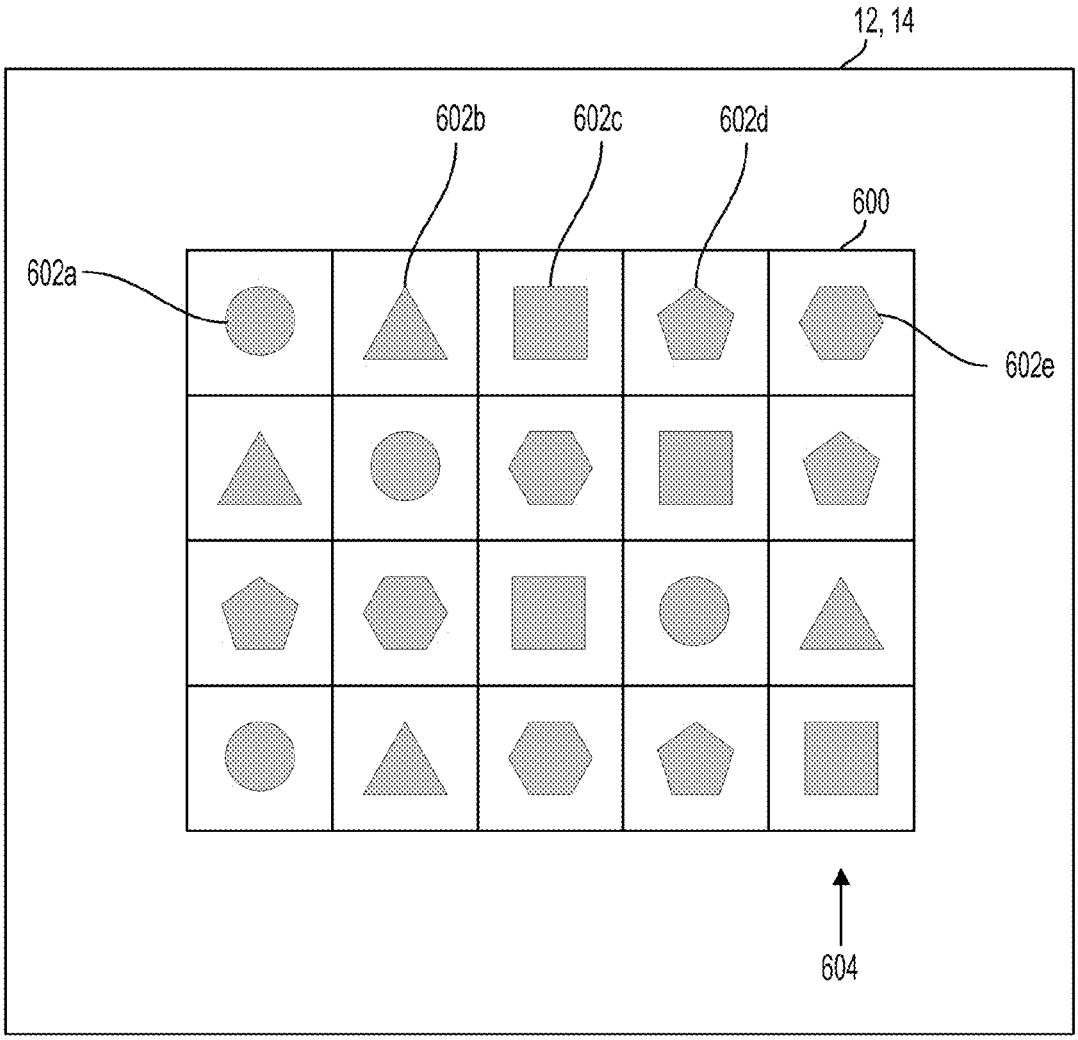

Game controller 44 may modify the visual representation of the skill-based game with the one or more selected game enhancement elements such that the enhanced skill-based game is more difficult than the skill-based game. For example, as depicted in FIG. 6B, game controller 44 may select a new game tile 602*e* for modifying the skill-based matching game. Game controller 44 may send a control command to display controller 52 to dynamically update the rendering of the viewing area using graphics processor 54 to include game tile 602*e* for the player to match with other game tiles. As depicted in FIG. 6B, game tiles 602*d* and 602*e* may appear similar but may depict different shapes. This may cause the player to, on one or more occasions, to believe that game times 602*d* and 602*e* depict the same shape. This may raise the difficulty of the skill-based matching game as it may challenge the visual and cognitive skills of the player.

As another example, as depicted in FIG. 6B, game controller 44 may select a new shape of matrix 600 for modifying the skill-based game. Game controller 44 may send a control command to display controller 52 to dynamically update the rendering of the viewing area using graphics processor 54 to include a new row 604 to populate with additional game tiles 602 for the player to match with other game tiles. A change in shape of matrix 600 and additional game tiles 602 in new row 604 may raise the difficulty of the skill-based matching game as the player has more games tiles 602 to view and match with other game tiles 602.

Similarly, game controller 44 may modify the visual representation of the skill-based game with the one or more selected game enhancement elements such that the enhanced skill-based game is easier than the skill-based game. The skill-based matching game as depicted in FIG. 6B may be rendered and displayed on display screen 12, 14 to the player of the skill-based game. Game processor 56 may compute the game skill level of the skill-based matching game as depicted in FIG. 6B. Game processor 56 may compute that the skill level of the skill-based matching game is a difficult skill-based matching game. Game controller 44 may detect in real time or near real time the game play of the player. Game controller 44 may compute the skill level of the player as a novice player. Game controller 44 may compare the skill level of the player (novice) and the skill level of the skill-based game (difficult), and may select one or more game enhancement elements. Game controller 44 may send a control command to display controller 52 to dynamically update the rendering of the viewing area using graphics processor 54 based on the selected game enhancement element, which may correspond to removing game tiles 602*e* from being displayed, and/or remove row 604 from matrix 600 such that matrix 600 of the enhanced skill-based matching game may be generally similar to matrix 600 as depicted in FIG. 6A, and that the enhanced skill-based matching game may be easier.

In some embodiments, game controller 44 may continuously compare the skill level of the player with the skill level of the game to select game enhancement elements for modifying the skill-based game.

For example, as discussed with respect to FIG. 6A and FIG. 6B, game controller 44 may select game enhancement elements for modifying the skill-based game such that the enhanced skill-based game may be more difficult than the skill-based game. As depicted in FIG. 6A and FIG. 6B, game controller 44 may determine that the skill level of the player is higher than the skill level of the game, and game controller 44 may select game tile 602*e* and row 604 for modifying the visual representation of the game play to generate an enhanced skill-based matching game.

Game processor 56 may compute the game skill level of the enhanced skill-based game as game controller 44 selects game enhancement elements and send a control command to the display controller 52 to modify the visual representation of the skill-based game with the game enhancement elements.

As the player plays the enhanced skill-based matching game as depicted in FIG. 6B, game controller 44 may detect additional game play data from the player and may compute a player skill level based on the detected additional game play data of the player. For example, a player playing the game of FIG. 6B may be proficient at matching the game tiles 602. Game controller 44 may compute that the player is a skilled player at the enhanced skill-based matching game. Game controller 44 may compare the skill level of the enhanced skill-based matching game as computed by game processor 56 and the skill level of the player as assessed by game controller 44, and may select one or more game enhancement elements generated by game processor 56. If a player is proficient at playing the enhanced skill-based matching game, game controller 44 may select one or more game enhancement elements for further modifying the skill-based game such that the further enhanced skill-based game may be more difficult than the enhanced skill-based game.

Figure 6C:
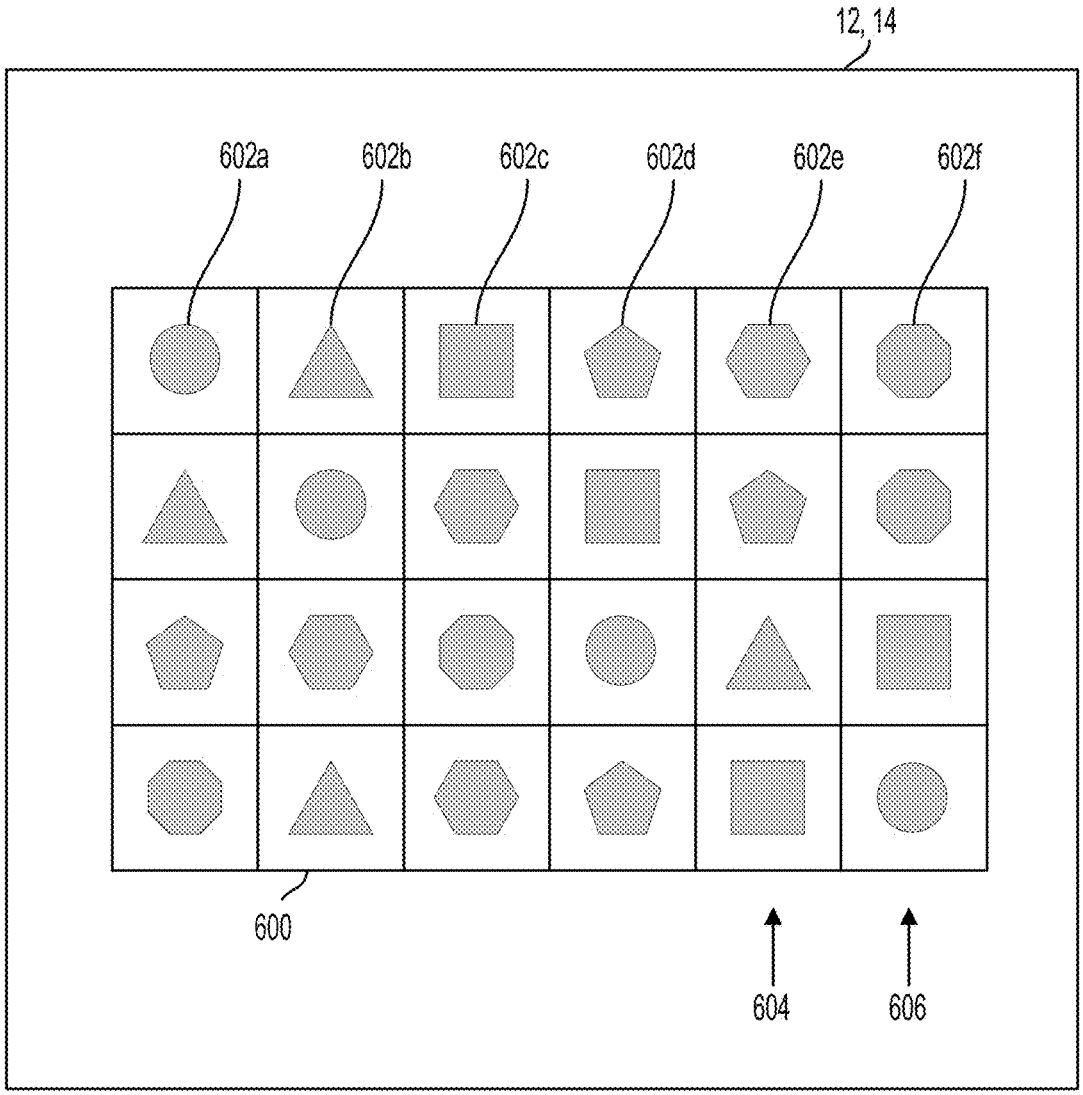

Game controller 44 may modify the visual representation of the skill-based game with the one or more selected game enhancement elements such that the further enhanced skill-based game is more difficult than the enhanced skill-based game. For example, as depicted in FIG. 6C, game controller 44 may select a new game tile 602*f* and/or a new row 606 for modifying the skill-based matching game. Game controller 44 may send a control command to display controller 52 to dynamically update the rendering of the viewing area using graphics processor 54 to include game tile 602*f* or row 606 populated with game tiles 602 for the player to match with other game tiles 602. The similarity of game tile 602*f* to game tiles 602*d* and 602*e* and/or the increased number of game tiles 602 may raise the difficulty of the skill-based matching game as it may challenge the visual and cognitive skills of the player.

Game controller 44 may continuously compare the skill level of the player with the skill level of the game to select game enhancement elements for modifying the skill-based game. Referring to FIG. 5, method 500 may iterate as long as the game playing session of the player is ongoing for game processor to compute the skill level of the skill-based game, whether it is the initial skill-based game, enhanced skill-based game, or further enhanced skill-based game, and for game controller 44 to compute the skill level of the player based on the detected game play by the player, select game enhancement elements by comparing the skill level of the skill-based game and the skill level of the player, and modifying visual representation of the skill-based game using the selected game enhancement elements. As the player plays the skill-based game, game controller 44 may modify the visual representation of the skill-based game using selected game enhancement elements such that the enhanced or further enhanced skill-based game may be harder or easier for the player, such that the player may be engaged when using EGM 10 to play a skill-based game.

In some embodiments, the game enhancement elements generated by game processor 56 may comprise a simulated player robot. Game controller 44 may modify the visual representation of the game play of the skill-based game by including the simulated player robot, the simulated player robot configured to interface with the device to automatically play the skill-based game.

For example, the game data of the skill-based game stored in data storage device 20 of EGM 10 may be a multi-player game, such as a poker game designed to be played by a pre-determined number of players. Multiple players may be playing on EGM 10, or a plurality of EGMs 10 may be in communication with each other through a network, such as a wired or wireless network. Based on the game data of the poker game, game processor 56 may be configured to automatically generate simulated player robots corresponding to a plurality of skill levels, play behaviours, styles, and/or tendencies of players of the poker game. For example, in the context of a poker game, game processor 56 may generate simulated player robots that may play a small number of hands, that may play a large number of poker hands, that may place bets aggressively, that may place bets conservatively, that may place large bets, that may place small bets, that may bet frequently, that may bet infrequently, or a combination thereof.

For example, game processor 56 may compute the game skill level of the poker game based on the game data of the poker game and/or game play data from the players of the poker game. In some embodiments, when game controller 44 initially renders the visual representation of game play for carrying out the poker game based on the game data for the players to play the game, game controller 44 may render visual representation using a simulated player robot that may correspond to a poker player with moderate play behaviours and tendencies. For example, the initial simulated player robot may play a moderate number of hands, may place bets moderately, may place moderate sized bets, and may bet at a moderate frequency. This simulated player robot with moderate play behaviours and moderate tendencies may be a reference simulated player robot with which game controller 44 uses to compare the skill level of the players. In some embodiments, the reference simulated player robot may be a simulated player robot with any type of play behaviour and play tendencies.

Game controller 44 may render visual representation of the poker game play for carrying out the poker game, and may detect the game play of the player or players playing the poker game.

Game controller 44 may compute the skill level of the player or players based on their detected game play. Upon comparison of the skill level of the player or players and the skill-level of the game, which may be the skill level of the simulated player robot with moderate play behaviours, game controller 44 may select one or more simulated player robots and modifying the visual representation of the poker game play using the one or more selected simulated player robots to generate an enhanced poker game. For example, the enhanced poker game may include visual representations of simulated player robots that may mirror the bet aggression, bet size, and/or bet frequency of the players. This may create an engaging poker gaming experience for the players.

Game controller 44 may send a control command based on the selected simulated player robots to display controller 52 to dynamically update the rendering of the viewing area using graphics processor 54. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent a visual update to the visible game components in the viewing area, the visual update based on the selected simulated player robots. For example, the graphical animation effect may be to depict an avatar representative of the simulated player robots that may be selected to play the poker game with the players.

In some embodiments, there may be sufficient players to initially play the poker game, so game controller 44 may not select simulated player robots for modifying the visual representation of the game play during the initial game play session of the poker game. Game controller 44 may continue to compute the skill level of the players and may compare the skill level of the players with a reference simulated player robot.

In some embodiments, there may be insufficient players to initially play the poker game, so game controller 44 may select simulated player robot for modifying the visual representation of the game play during the initial game play session of the poker game. Game controller 44 may select a reference simulated player robot, such as a simulated player robot with moderate play behaviour and play tendencies, to be rendered and visually represented for carrying out the initial game play of the poker game with the players.

In some embodiments, as one or more players stop playing the poker game, game controller 44 may modify the visual representation of the game play of the poker game using simulated player robots such that the simulated player robots may replace the position vacated by the players who stopped playing the poker game. The simulated player robots selected to modify the visual game play of the poker game may be linked to the comparison of the skill level of the players with a reference simulated player robot, or a comparison of the skill level of the players with respect to all other players of the poker game.

In some embodiments, game controller 44 may compute certain skills of the player based on the detected game play of the player. Game controller 44 may compute the reaction time, stress management, visual and organization skills, coordination skills, audio skills, problem solving skills, and haptic/tactile skills of the player.

Figure 7:
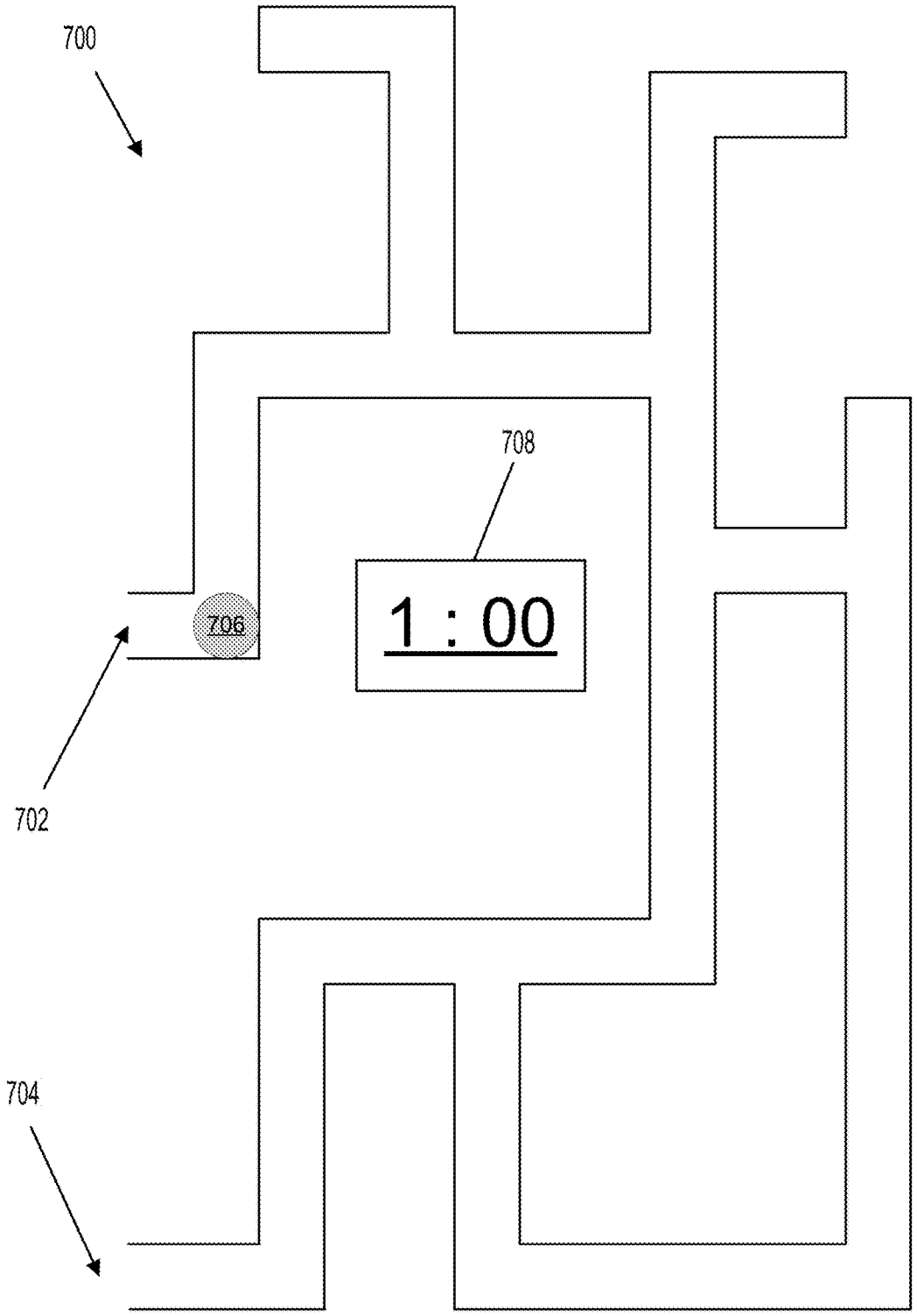
FIG. 7 is a schematic diagram illustrating a skill-based maze game rendered by an electronic gaming machine according to some embodiments.

For example, as depicted in FIG. 7, the skill-based game may be a maze game where a player has to navigate through the maze within a certain period of time. A game component of the skill-based maze game may be a maze 700, with an entrance 702 and an exit 704. Game controller 44 may render visual representation of an avatar 706 for a player to guide through the maze 700 by actuating player control inputs 50 and/or pressing virtual buttons displayed on display screen 12, 14. The player control inputs 50 and/or virtual buttons displayed on display screen 12, 14 may correspond to directions of movement for avatar 706. Game controller 44 may render a visual representation of a time meter 708 to indicate the amount of time remaining for the player to guide avatar 706 to exit 704. As depicted in FIG. 7, there may be one minute left for the player to guide avatar 706 to exit 704.

Game processor 56 may generate game enhancement elements that may correspond to an optimal route for traversing maze 700.

As the player plays the maze game, game controller 44 may detect the input of the player, which may comprise the number of actuations of player control inputs 50, number of presses of virtual buttons displayed on display screen 12, 14, whether the player finishes the maze, the amount of time remaining on time meter 708, and the like. Based on the game play of the player in the maze game, game controller 44 may determine the reaction time, stress management skills, visual and organization skills, and coordination skills of the player.

In some embodiments, game controller 44 may compute the player skill level using one or more skill-determining factors, such as: reaction time, memory, coordination, game session length, play behavior, game behavior, game language, game location, game selection, elapsed time with one game, wagering behavior, game type, game theme, wager amounts, wager denominations, play rates, typical bonus values, game brand, prize distributions, amounts of incremental wagers, frequency of wagering, for instance the presence or absence of multiple rounds of wagering in a game, the number of rounds of wagers permitted in a game, maximum wager amounts permitted, minimum wager amounts permitted, amount of wagering, elapsed time between selected events for instance starting a new game, reaction to bonus rounds, reaction to progressive outputs, pay table features, amount of incremental wagers, frequency of wagering, elapsed time for player reaction, amount of wagering, elapsed time between wagers, frequency of player action, game rules, game complexity, ability for a player to control or have an effect on a game outcome, whether an outcome is predetermined, whether parallel wagering is provided, average game speed, average wager amounts, average wager rate, presence or frequency of bonus rounds, presence and frequency of progressive outputs, payout percentages, win rates, win percentages, loss rates, loss percentages, use of special features, frequency of use of special features, number of lines played, total amount wagered, and type of payment received.

In some embodiments, game controller 44 may award the player for demonstrating skill such as by overcoming the one or more game enhancement elements selected for modifying the visual representation of the game play. Game controller 44 may award a certain baseline award to a player for playing the skill-based game, and game controller 44 may award an additional award to the player for demonstrating skill. Game controller 44 may detect additional real-time game play by the player of the enhanced skill-based game, the additional game play involving interaction with the one or more generated game enhancement elements. Game controller 44 may further award the player based on the additional game play and the comparison of the game skill level and the player skill level, such as by triggering transfer of virtual credits to the player account of the player using the card reader and the token.

For example, for a skill-based game, game controller 44 may render a visual representation of a polygonal shape on display screen 12, 14, and may further render a visual representation of a question on display screen 12, 14, asking the player for an input corresponding to the number of sides of the polygon. The possible answers may be rendered as game tiles on display screen 12, 14. To answer the question, a player may press a portion of display screen 12, 14 corresponding to the location of the game tiles on display screen 12, 14. Game controller 44 may detect the player pressing the portion of display screen 12, 14, and may compare the number depicted on the game tile with the actual number of sides of the polygon. An incorrect answer may result in a base level payout by game controller 44. A correct answer by the player, which may be a demonstration by the player of the player's observation and problem solving skills, may result in a higher payout.

Figure 8:
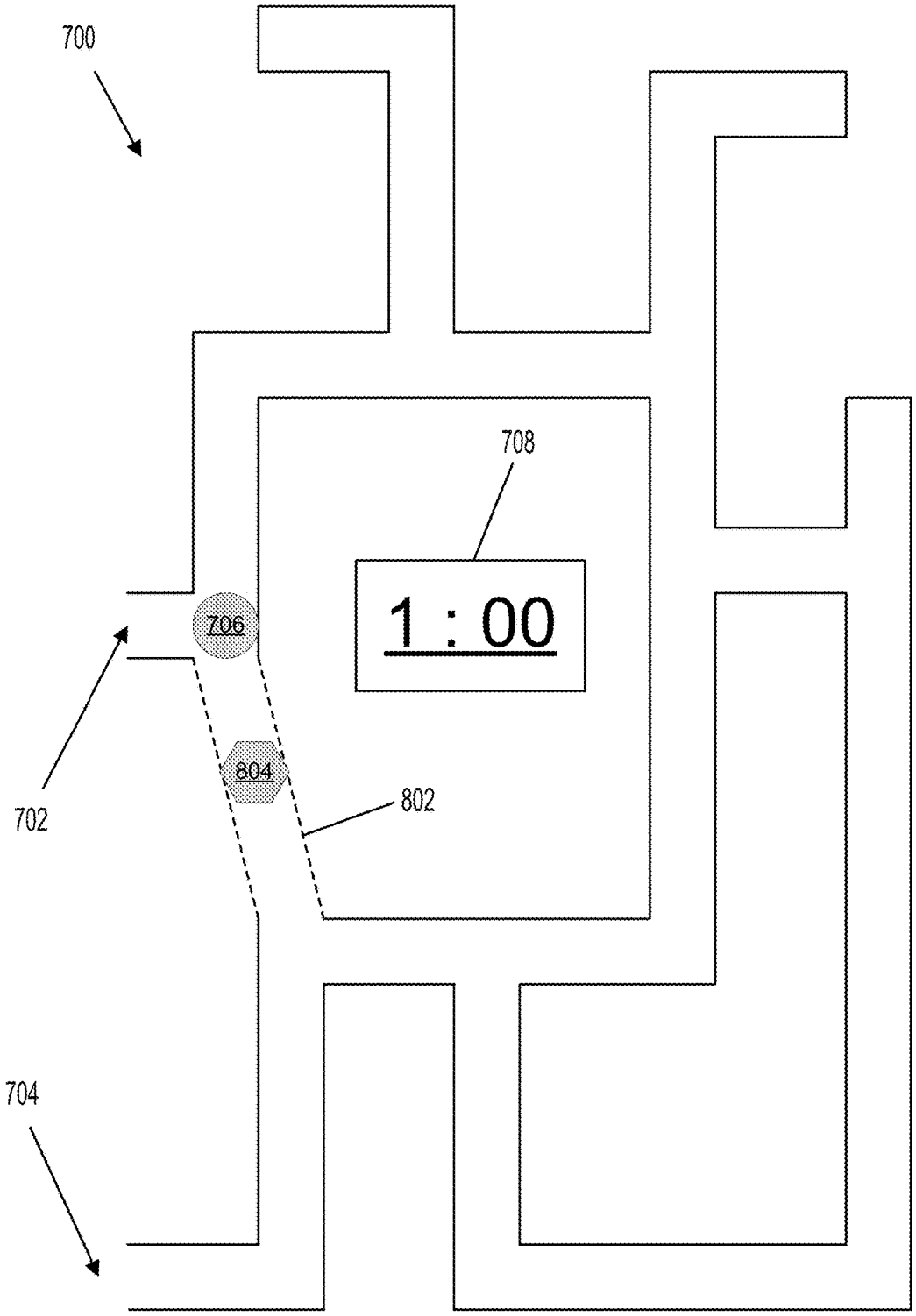
FIG. 8 is a schematic diagram illustrating a skill-based maze game modified with game enhancement elements according to some embodiments.

As another example, as illustrated in FIG. 8, a player may play a skill-based maze game generally similar to the maze game depicted in FIG. 7. Game processor 56 may compute the skill level of the maze game, and game controller 44 may compute the player's skill level for playing the maze game as the player plays the game and game controller 44 detects the game play from the player. Game controller 44 may compare the player's skill level with the skill level of the maze game. Game controller 44 may determine that a player has a higher skill level than the maze game. Game controller 44 may select one or more game enhancement elements for modifying the visual representation of the game play. In some embodiments, when game controller 44 detects that the player has a skill level higher than a pre-determined skill level threshold, game controller 44 may select one or more game enhancement elements for modifying the visual representation of the game play such that there may be multiple options to play the maze game.

The player may have the option to solve the maze using a route that may not comprise any game enhancement elements selected by game controller 44 for modifying the visual representation of the game play. Game controller 44 may award the player for solving maze 700 with the route not comprising any game enhancement elements a baseline payout.

Game controller 44 may select a game enhancement element for modifying the visual representation of the game play of the maze game that may represent a shorter route to solve a maze. As depicted in FIG. 8, game controller 44 may send a control command to display controller 52 to render a shortcut 802 on display screen 12, 14 using graphics controller 54. Shortcut 802 may comprise a game enhancement element that may be rendered as an impediment 804 that a user may overcome by demonstrating skill. In some embodiments, impediment 804 may comprise a pit and a revolving gate. The player may have to demonstrate good reaction time and coordination, for example, by pressing a button on the player control inputs 50 and/or a virtual button displayed on display screen 12, 14 to cause avatar 706 to jump over the pit without being blocked by the revolving gate.

Game controller 44 may detect additional game play of the player, such as pressing a button on the player control inputs 50 and/or a virtual button displayed on display screen 12, 14, that may correspond to the player using shortcut 802 and overcoming impediment 804 to guide avatar 706 to the exit 704 of maze 700. A player completing maze 700 using shortcut 802 and overcoming impediment 804 may be demonstrating timing and coordination. The player may complete the maze using the shorter route, and game controller 44 may award the player with a higher payout.

As yet another example, a puzzle for a skill-based puzzle game may be solved with a certain number of steps. Based on the game data, game processor 56 may compute that the puzzle may be optimally solved using a minimum number of steps, or may be solved using more than the minimum number of steps. Game controller 44 may select a game enhancement element such that the minimum number of steps required to solve the puzzle may increase or decrease, as computed by game processor 56. Game controller 44 may further determine a threshold number of steps for solving the puzzle based on the game enhancement elements used to modify the puzzle game, such that a player that solves the puzzle using more than the threshold number of steps may receive a baseline payout, and a player that solves the puzzle using fewer than the threshold number of steps may receive a higher payout.

In some embodiments, game controller 44 may change the frequency of payout based on the computed skill level of the player. Game controller 44 may award a baseline payout when a player plays a skill-based game. Game controller 44 may detect the game play of the player and may compute the skill level of the player. Game controller 44 may compare the skill level of the player with a pre-determined threshold of skill. In some embodiments, the pre-determined threshold of skill may reflect a relatively high skill level. If game controller 44 determines that the skill level of the player is higher than a pre-determined threshold, game controller 44 may select game enhancement elements for modifying the visual representation of the game play of the skill-based game, such that the frequency of winning is more volatile, but the quantity of award for each win may be larger. In some embodiments, game controller 44 may send a control command to display controller 52 to render a visual representation of a text box containing a prompt to notify the player that the skill-based game may become more volatile.

In some embodiments, the player may choose not to change the frequency of winning in the skill-based game. The pre-determined threshold may reflect a relatively high skill level such that when game controller 44 determines that the skill level of the player is higher than the pre-determined threshold of skill, it may indicate that the player is a relatively high skilled player who may be more engaged with the skill-based game when additional volatility is introduced to the game.

In some embodiments, the data storage device 20 storing game data for the skill-based game may store game data for one or more primary skill-based games and one or more bonus skill-based games. Game controller 44 may be configured to trigger a bonus skill-based game based on the additional game play data and the comparison of the game skill level and the player skill level.

For example, a player may play a skill-based game. Game controller 44 may compute the skill level of the player and compare the skill level of the player with the skill level of the game. Game controller 44 may select one or more game enhancement elements based on the comparison of the skill levels of the player and the game to modify the skill-based game to generate an enhanced skill-based game. Game controller 44 may send a control command to display controller 52 based on the one or more selected game enhancement elements to dynamically update the rendering of the viewing area using graphics processor 54. In response to the control command, the display controller 52 may control the display screen 12, 14 in real-time or near real-time using the graphics processor 54 to dynamically update the rendering of the viewing area. A real-time or near real-time graphical animation effect displayed on the display screen 12, 14 may represent a visual update to the visible game components in the viewing area. The visual update may be based on the one or more selected game enhancement elements.

Game controller 44 may detect additional real-time game play by the player of the enhanced skill-based game, the additional game play involving interaction with the one or more generated game enhancement elements. Based on the additional real-time game play by the player of the enhanced skill-based game, game controller 44 may compute that the player is demonstrating a high level of skill. In addition, game controller 44 may compare the skill level of the player based on the additional game play data with the skill level of the enhanced skill-based game as determined by game processor 56. This comparison may indicate that the player is still demonstrating high skill relative to the game. Game controller 44 may be configured to trigger a bonus game when it computes that the level of skill demonstrated by the player is high and that the player is exceeding the skill of the skill-based game.

Game controller 44 may send a control command to display controller 52 to dynamically update the rendering of the viewing area using graphics processor 54 to trigger the bonus game. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent triggering a bonus skill-based game based on the additional game play data of the player and the comparison between the skill level of the player and the skill-based game.

In some embodiments, game data for the primary skill-based game and/or the bonus skill-based game, game controller 54, game processor 56, and all game play data detected by game controller 54 may be stored in a distributed configuration across a variety of devices. The devices may be located in different jurisdictions and may contain different subsets of game data, game play data, and computing hardware. The devices may store overlapping data in some example embodiments. The data may be exported to other servers due to the large amount of data and the resource restrictions of a single server. Further, data may be exported to generate a collective pool of data for data mining and analysis. For example, the collective pool of data may be used as historical and/or comparative data for determining the skill level of the player, selecting an appropriate game enhancement element, and so on.

Game play data may be collected from game play by players playing a skill-based game on EGM 10 located in a jurisdiction and stored locally on data storage devices. The game play data may include player data including private information about a player, such as their name, credit score, credit card number, citizenship, residency, address, phone-number, total spending amount, and the like. This information may be collected when a player registers to play the skill-based game example. Gaming and privacy regulations may govern and restrict where the private data may be stored and which locations the private data may be transferred to. User preferences may also restrict access and export of private data.

It may be desirable to pool game data, game play data, game processor 56, game controller 44, or a combination thereof, at a central server or a collection of distributed central servers to collect a large amount of game data and game play data for computing the skill level of the player and generating game enhancement elements. The central server(s) may coordinate analytics for skill level computing and game enhancement elements generation between different servers and jurisdictions. This may provide increased processing power, increased efficiency in generating game enhancement elements and determining the skill level of players, increased memory resources for large amounts of data, and access to a larger data set.

If the central server is located in one or more different jurisdictions than where the data was originally collected, then the gaming and privacy regulations and user preferences may restrict the export of the private data (a subset of the game play data) to the central server. Accordingly, the private data may be separated from the non-private gaming behavior data, where only the non-private data may be transferred. Further, a summary of private data may be generated such that the summary abstracts from and summarizes the private data to generate non-private summary data. The non-private data may be anonymous data but may include game factors used to compute the skill level of players and/or game data for generating game enhancement elements. The data may also be separated to reduce the amount of data to be stored on a single data storage device.

Local servers may be configured with parsing rules to implement regulatory restrictions and user preferences to govern export of data to the central server(s). That is, local servers may be configured with parsing rules to process game data and game play data stored thereon to generate export data for transmission to the central server. The local export servers may be configured with parsing rules specific to regulatory requirements of relevant jurisdictions (e.g. privacy regulation) and user preferences (current location of data, location that data will be exported to). For example, game data and game play data may include private and non-private data, and the local servers may separate the private and non-private data based on the parsing rules and apply tags to the exported data. To separate the private data (e.g. personal information about players) from the non-private data (e.g. playing behavior) a hashing algorithm may be used to create an index or tag linking the private and non-private data. That is, a tag for the non-private data may identify (directly or indirectly) associated private data. The tag or index may otherwise provide relevant information about the non-private data such as the location or jurisdiction it is coming from. This may enable central server(s) to aggregate data based on the tag. For example, the non-private data may be aggregated based on location or jurisdiction.

The collective pool of data on central server(s) may be partitioned by jurisdiction, tag, game, and the like. The tag may include jurisdictional data. When the collective pool of data is used to compute skill level of the player and generate game enhancement elements, different weightings can be applied to the data based on jurisdiction. For example, a skill level of a Canadian player playing a game in the United States may be generated by weighting Canadian data more than data from other jurisdictions. The collective pool of data may provide a larger data set (e.g. playing data from multiple countries) to improve computing skill levels of players and generating game enhancement elements. Trends and playing behavior may be analyzed using the collective pool of data and tags.

FIG. 9 depicts a system 900 for generating game enhancement elements, computing the skill level of a player, and selecting game enhancement elements to modify a skill-based game as described herein. System 900 may comprise a central server 902 configured as a server for a plurality of clients 904. In some embodiments, central server 902 and clients 904 may be a set of networked EGMs 10. Game data of the skill-based game, generated game enhancement elements generated by the game processor 56, and/or game play detected by game controller 44 may be stored in distributed fashion on local data storage devices 906 and/or central data storage servers 908. Local data storage devices 906 and central data storage servers 908 may be in different or the same jurisdictions. The game data of the skill-based game, generated game enhancement elements generated by the game processor 56, and/or game play detected by game controller 44 may be exported from local data storage devices 906 to central data storage servers 908 using parsing rules. The parsing rules may be in accordance with privacy and regulatory restrictions.

In some embodiments, central server 902 may comprise a game controller 910, generally similar to game controller 44, and a game processor 912, generally similar to game processor 56, for generating game enhancement elements, computing the skill level of a player, and selecting game enhancement elements to modify a skill-based game as described herein.

In some embodiments, central server 902 may coordinate game controller 910, game processor 912, and the game controllers and game processors of clients 904 for generating game enhancement elements, computing the skill level of a player, and selecting game enhancement elements to modify a skill-based game.

Central server 902 and clients 904 may be in wired or wireless connection. In some embodiments, central server 902 and clients 904 may be coupled to a network 914. The network 914 may include a social media network or other suitable network such as a WAN or LAN. The network 914 may include wireless capabilities to connect to one or more of clients 904 with central server 902. Game play data may be collected from clients 904 and sent through the network 914 infrastructure back to the central server 902. Clients 904 may be wired or wireless gaming devices in any type of gaming setting, for instance dedicated EGM 10 as are commonly found in casinos and other venues.

Figure 10:
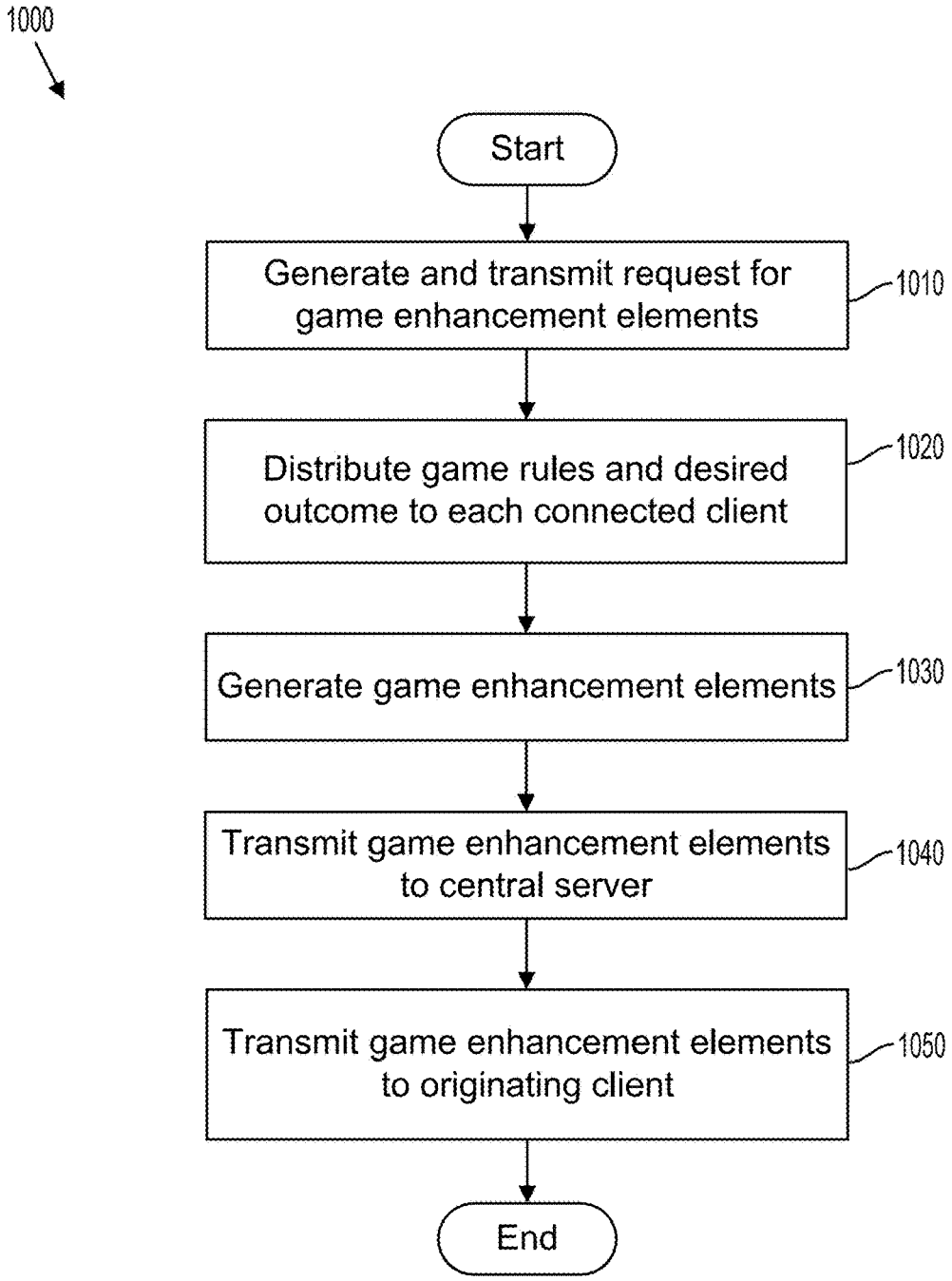
FIG. 10 is a flowchart diagram of a method implemented by a system of networked clients and a central server for generating game enhancement elements according to some embodiments.

FIG. 10 depicts a method 1000 of generating game enhancement elements using the system 900 of FIG. 9.

At 1010, client 904 generates and transmits an originating request for game enhancement elements. Game data of the skill-based game and the desired outcome of the iterative process for game enhancement elements are also sent from client 904 to central server 902. For example, pre-configuration data including termination criteria for the iterative process to generate game enhancement elements may be transmitted to central server 902. In some embodiments, the iterative process for generating the game enhancement elements may terminate when it has generated a plurality of game enhancement elements that may reflect a range of skill levels of a player of the skill-based game. In some embodiments, the termination criteria may be when the fitness scores of numerous successive best-of-generation individuals reaches a plateau, and the single best individual may be designated as the result of the iterative process.

At 1020, once client 904 sends a request for game enhancement elements, game data, and the desired outcome of the iterative process for generating game enhancement elements to central server 902, central server 902 may distribute the game rules and one set of objectives of the game enhancement elements generation to each connected client 904 to generate the game enhancement elements.

At 1030, clients 904 may receive the game rules and one set of objectives of the game enhancement elements generation from central server 902, and may generate the game enhancement elements as described herein.

At 1040, once the clients 904 connected to central server 902 generate the game enhancement elements for the game rules and expected outcomes, clients 904 transmit the game enhancement elements back to central server 902. If there are insufficient clients 904 for the number of expected outcomes then as clients 904 generate game enhancement elements, clients 904 that have finished generating their assigned game enhancement elements continue to generate the remaining game enhancement elements.

At 1050, once central server 902 receives all the game enhancement elements, central server 902 sends the generated game enhancement elements to the client 904 that sent the originating request to central server 902 for game enhancement elements. The client 904 may use the generated game enhancement elements for the skill-based game.

In some embodiments, as depicted in FIG. 2E, EGM 10 may comprise a rules processor 58 in connection with the data storage device 20 storing the game data for the skill-based game and/or the bonus skill-based game. Rules processor 58 may be configured to enable portions of the game data and disable other portions of the game data.

Rules processor 58 may be configured to enable and/or disable portions of the game data randomly. Rules processor 58 may comprise a random number generator and/or a pseudo-random number generator. Rules processor 58 may send a control command to the random number generator to generate a random number. Based on the random number, the rules processor 58 may enable and/or disable a portion of the game data. In some embodiments, EGM 10 may comprise a clock, and rules processor 58 may be configured to enable and/or disable portions of the game data randomly based on the time according to the clock of EGM 10.

Rules processor 58 may also be in connection with game controller 44. As game controller 44 detects game play from the player in real-time or near real-time, game controller 44 may compute the skill level of the player. Game controller 44 may send a command to rules processor 58 indicating the skill level of the player. Based on the skill level of the player, rules processor 58 may enable and/or disable portions of the game data.

In some embodiments, game controller 44 may send a control command to display controller 52 to dynamically update the rendering of the viewing area using graphics processor 54 to display a user preferences menu. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent displaying a user preferences menu in the viewing area. The player may provide game play data based on the user preferences by selecting their preferences on the displayed menu. Game controller 44 may detect the game play data corresponding to the player's input of their preferences, and may send this packet of user preference game play data to the rules processor 58. Based on this user preference game play data, the rules processor 58 may enable and/or disable a portion of the game data of the skill-based game.

In some embodiments, rules processor 58 may enable and/or a disable a portion of the game data based on the game play of the player as detected by game controller 44.

Rules processor 58 may enable a portion of the game data of the skill-based game and disable the remaining portion of the game data for the purpose of generating game enhancement elements, for rendering visual representation of game play, and for carrying out the skill-based game. Game processor 56 may generate the game enhancement elements using only the enabled portion of the game data, and game controller 44 may render visual representation of game play for carrying out the skill-based game based on the enabled portion of the game data.

For example, a player may be playing a skill-based maze game generally similar to the maze game as depicted in FIG. 7 and FIG. 8. Initially, the enabled portion of the game data for the skill-based maze game may be basic game data relating to guiding an avatar from an entrance of the maze to the end of the maze. Game processor 56 may generate the game enhancement elements using only the enabled portion of the game data for the skill-based maze game, and game controller 44 may render visual representation of game play for carrying out the skill-based maze game based on the enabled portion of the game data. As the player is playing the skill-based maze game, rules processor 58 may randomly enable previously disabled game data, such as game data relating to triggering teleportation from one area of the maze to another if the player guides an avatar to step on a certain square, or that the player loses the game if the player guides the avatar to a certain square. Game processor 56 may generate game enhancement elements using the newly enabled portions of the game data of the skill-based maze game.

In some embodiments, game controller 44 and/or game processor 56 may perform the functions of rules processor 58.

In some embodiments, as EGM 10 is turned on and the skill-based game is loading onto EGM 10, game controller 44 may be initializing the skill-based game based on the game data. Game controller 44 may be calculating paths for path finding, rendering vector graphics, saving pre-calculated byte data to data storage device 20, and loading data into memory. Game controller 44 may be sending a control command for graphics processor 54 to read game data and generate game components of the skill-based game and the interactive game environment. Where EGM 10 is connected to a central server, game controller 44 may be downloading external data, such as game data of the skill-based game, sound files, graphics files, data files from the central server.

Game processor 56 may be configured to generate game enhancement elements as EGM 10 is turned on and the skill-based game is loading. Game processor 56 may generate game enhancement elements as soon as game data of the skill-based game is saved to the data storage device 20 of EGM 10. Game processor 56 may also be configured to generate game enhancement elements as rules processor 58 enables and/or disables portion of the game data of the skill-based game.

In some embodiments, as described herein, game controller 44 may detect real time or near real time game play of the skill-based game by the player and compute the skill level of the player. Game controller 44 may select game enhancement elements generated by game processor 56 by comparing the skill level of the game, as determined by the game processor 56, with the skill level of the player. Game controller 44 may modify the visual representation of the game play of the skill-based game with the selected game enhancement elements.

In some embodiments, game controller 44 may select game enhancement elements to modify the visual representation of the game play of the skill-based game based on preferences of the player.

Game controller 44 may send a control command to display controller 52 to dynamically update the rendering of the viewing area using graphics processor 54 to display a user preferences menu comprising one or more user preference questions. In response to the control command, the display controller 52 may control the display screen 12, 14 in real-time or near real-time using the graphics processor 54 to dynamically update the rendering of the viewing area to provide a real-time or near real-time graphical animation effect displayed on the display screen 12, 14 that may represent displaying a user preferences menu in the viewing area. The player may provide game play data based on the user preferences by selecting their preferences on the displayed menu. Game controller 44 may detect the game play data corresponding to the player's input of their preferences. Based on this user preference game play data, game controller 44 may select a game enhancement element generated by game processor 56 for modifying the visual representation of the game play using the one or more selected game enhancement elements to generate an enhanced skill-based game.

Figure 11:
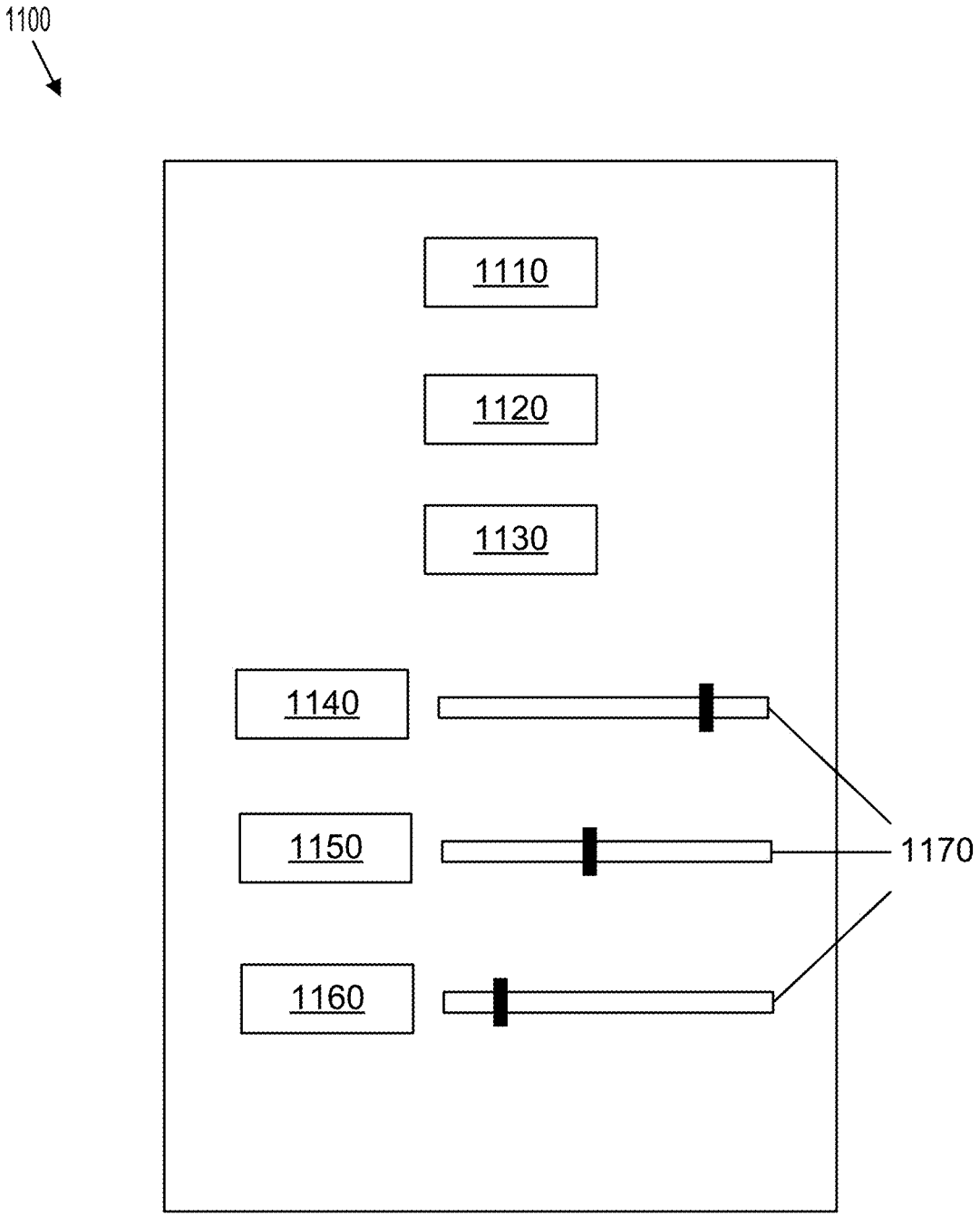
FIG. 11 is a schematic diagram of a user preference menu rendered by an electronic gaming machine according to some embodiments.

FIG. 11 depicts an example user preferences menu 1100. User preferences menu may comprise questions 1110, 1120, and 1130, which may be questions that the player may answer with a "yes" or "no" response, such as their preferred games or favourite moments of their game play. Certain buttons or panels of player control inputs 50 may light up to correspond to the questions 1110, 1120, and/or 1130, which may provide an input device for the player to answer questions 1110, 1120, and/or 1130. Questions 1110, 1120, and/or 1130 may ask the player about their perceived proficiency in certain skills, such as their reaction time, stress management, visual and organization skills, coordination skills, audio skills, and haptic/tactile skills of the player.

User preferences menu 1100 may also comprise questions 1140, 1150, and 1160. Questions 1140, 1150, and 1160 may ask questions which may have a range of answers. User preferences menu 1100 may comprise sliders 1170 for the player to answer questions 1140, 1150, and 1160. The player may press and drag the portion of display screen 12, 14 where sliders 1170 are rendered and displayed to answer questions 1140, 1150, and 1160.

In some embodiments, game controller 44 may select game enhancement elements to modify the visual representation of the game play of the skill-based game based on preferences of the player as determined from the game play of the player.

For example, a player may be playing a skill-based maze game as depicted in FIG. 7 and FIG. 8. Game controller 44 may have modified the game play of the skill-based maze game with shortcut 802 and impediment 804. The player may input game play data corresponding to continuously or frequently choosing to use shortcut 802 and attempting to overcome impediment 804 to reach exit 704. Game controller 44 may detect this game play data from the player and may compute that the player prefers the game play that may be provided by game enhancement elements similar to shortcut 802 and impediment 804. Game controller 44 may select game enhancement elements generated by game processor 56 that may be similar to shortcut 802 and impediment 804 for modifying the visual representation of game play of the skill-based maze game.

Figure 12:
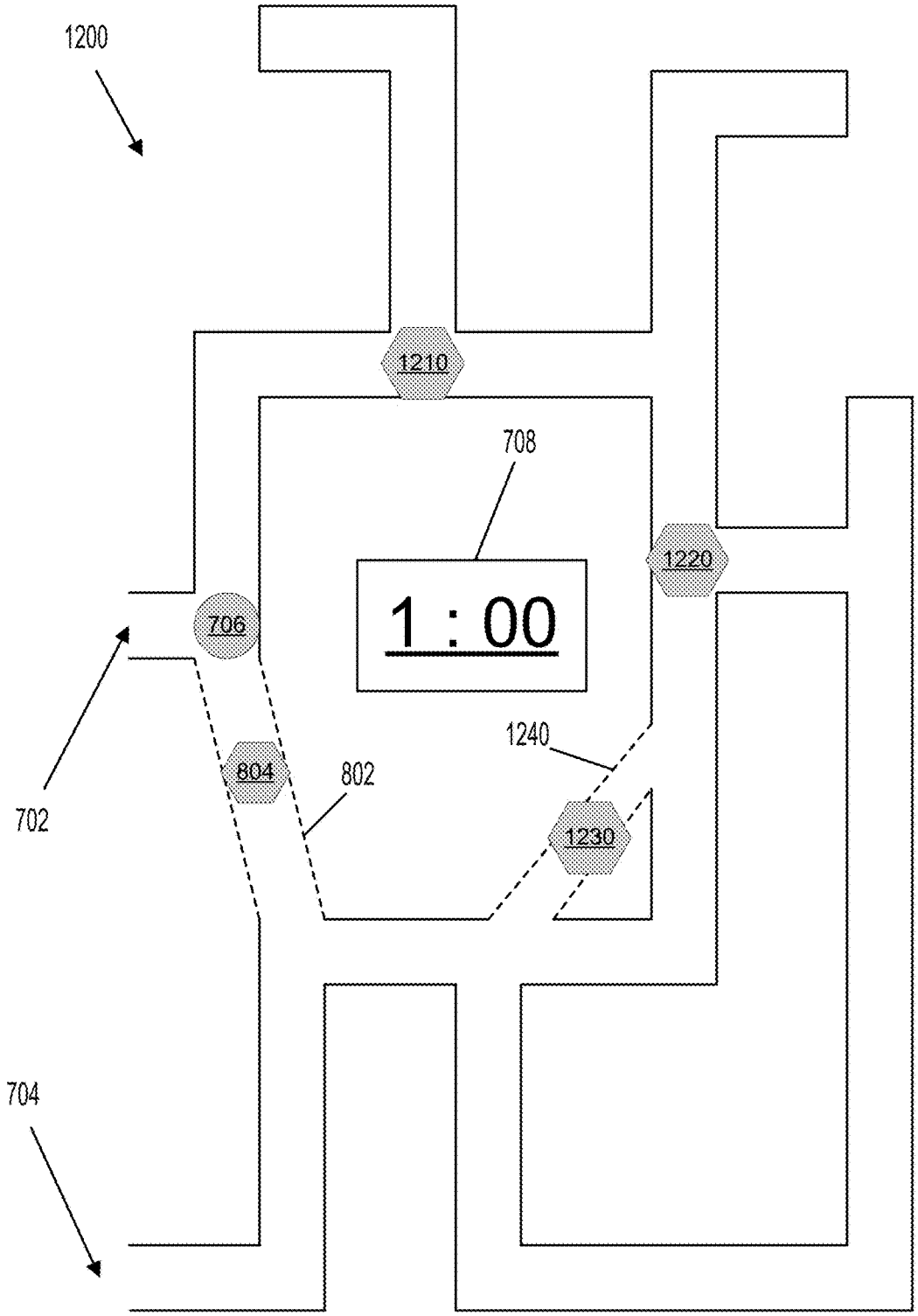
FIG. 12 is a schematic diagram illustrating a skill-based maze game modified with game enhancement elements according to some embodiments.

FIG. 12 depicts a maze 1200 that may be a game component of a skill-based maze game. Maze 1200 may be generally similar to maze 700 as depicted in FIG. 7, except game controller 44 may have selected game enhancement elements that may be similar to shortcut 802 and impediment 804 for modifying the visual representation of the game play of the skill-based maze game of FIG. 7. As illustrated in FIG. 12, game controller 44 may have selected additional impediments 1210, 1220, and 1230 and additional shortcut 1240 for modifying the visual representation of the skill-based game. Game controller 44 may send a control command to display controller 52 to dynamically update the rendering of the viewing area using graphics processor 54 to render visual representation of additional impediments 1210, 1220, and 1230 and additional shortcut 1240 on display screen 12, 14. The player may be engaged when playing the skill-based maze game comprising additional impediments 1210, 1220, and 1230 and additional shortcut 1240.

In some embodiments, certain game features may be enabled or disabled based on the skill level of the player as computed by game controller 44. For example, when game controller 44 computes that the skill level of a player, game controller 44 may determine that the skill level of the player is relatively high, and/or is above a pre-defined threshold. Game controller 44 may select game enhancement elements for modifying the visual representation of the skill-based game. The game enhancement elements may correspond to enhanced features and graphical animations for the skill-based game. For example, the game enhancement elements may represent game symbols for bonus awards, such as point double-up's, point triple-up's, power up's, and the like. For a relatively skilled player, modifying the visual representation of the skill-based game with enhanced features and graphical animations may raise the difficulty of the game and may provide an engaging gaming experience for the player.

Such game enhancement elements may be selected for modifying the skill-based game after the player has achieved or exceeded a certain skill level because such game enhancement elements may reduce the engagement of the skill-based game for a relatively novice player. Introducing bonuses and power-up's when the player has novice skill level may be overwhelming to the player and may discourage the player from playing the skill-based game.

Similarly, game controller 44 may modify the visual representation of the skill-based game corresponding to removing game enhancement elements if game controller 44 computes that the player has a relatively slow skill level to reduce distractions for the player when playing the skill-based game.

In some embodiments, game controller 44 may compute whether a player is cheating when playing the skill-based game using the game play data of the player detected by game controller 44 and the game enhancement elements generated by game processor 56.

To determine if a player is cheating, game processor 56 may be configured to generate a simulated player robot that may correspond to a player playing the skill-based game perfectly and optimally.

As described herein with reference to FIG. 4, game processor 56 may use an iterative process to generate game enhancement elements. Game processor 56 may be pre-configured with termination criteria for determining when game processor 56 should terminate the iterative process for generating game enhancement elements. In some embodiments, the termination criteria may be when the fitness scores of numerous successive best-of-generation individuals reaches a plateau. When pre-configured with this kind of termination criteria, game processor 56 may identify a game enhancement element, such as an optimal simulated player robot, that may represent a player that plays the skill-based game perfectly and optimally.

Game controller 44 may be configured to generate simulated game play data by using the optimal simulated player robot to play the skill-based game. The simulated game play data may correspond to optimal play behaviours and play tendencies at any moment of the skill-based game.

Game controller 44 may be configured to compute when a player is cheating when playing the skill-based game by comparing the game play data of the player with the simulated game play data of the optimal simulated player robot.

When the player plays the skill-based game properly, the player may sometimes make correct plays and other times make mistakes. The player may not play the skill-based game optimally, such that the player's play behaviour and play tendencies may not align with the simulated game play data of the optimal simulated player robot. When a player is cheating, the player's play behaviour and play tendencies may align with the simulated game play data of the optimal simulated player robot. Game controller 44 may be configured to perform statistical analyses and pattern recognition on the game play data of the player to determine the relationship between the game play data of the player with the simulated game play data of the optimal simulated player robot.

Example statistical analyses techniques that game controller 44 may be configured to perform include analysis of variance (ANOVA), chi-squared test, correlation, factor analysis, Mann-Whitney U, mean square weighted deviation (MSWD), Pearson product-moment correlation coefficient, regression analysis, Spearman's rank correlation coefficient, Student's t-test, time series analysis, and conjoint analysis.

Example pattern recognition techniques that game controller 44 may be configured to perform include classification, clustering, ensemble learning, multi-linear subspace learning, real-value sequence labeling, regression, and sequence labeling techniques.

Based on the outcome of the statistical analyses and pattern recognition techniques when comparing the game play data of the player and the simulated game play data of the optimal simulated player robot, game controller 44 may determine if the player is cheating when playing the skill-based game.

In some embodiments, system 900 may determine if multiple players are cheating when playing a skill-based game in a generally similar manner as described above. The central server 902, clients 904, or a combination thereof, may compute whether the player is cheating.

In some embodiments, where the player is playing the skill-based game on a networked gaming system similar to system 900, client 904 on which the player is playing the skill-based game may transmit game play of the player for the central server 902 to compute whether the player is cheating.

If it is determined that the player is cheating, EGM 10 and/or system 900 may send a command to a local server, which may be located at a casino but physically separate from EGM 10 and/or system 900. The command may be displayed on a display screen of the local server to alert casino staff to monitor the player or players that may be cheating when playing the skill-based game.

In some embodiments, game data for the primary skill-based game and/or the bonus skill-based game may relate to a single-player game and/or a multi-player game.

For a single-player game, the player may play the game on EGM 10 as depicted in FIG. 1 or on a client 904 of system 900 as depicted in FIG. 9.

For a multi-player game, the multiple players may play the game on EGM 10 as depicted in FIG. 1 or on separate clients 904 of system 900 as depicted in FIG. 9.

In some embodiments, EGM 10 may change the difficulty of the skill-based game by modifying the skill-based game using game enhancement data.

EGM 10 may comprise data storage device 20 for storing game data for the skill-based game, a card reader to receive a token for player account of a player to initiate the skill-based game, and a display screen for providing a visual rendering for the skill-based game.

Game processer 56 of EGM 10 may be configured to automatically generate game enhancement data using the game data. In some embodiments, game enhancement data may correspond to game rules that may modify game data such that the game play may be easier or more difficult as compared to the game play corresponding to the game data. Game enhancement data may be generated using an iterative process in a manner generally similar to the method 400 as described herein with respect to game enhancement elements.

Game processor 56 may compute a game skill level by playing the skill-based game using the game data.

Game controller 44 may be connected to the data storage device 20 and the display screen 12, 14 to control the skill-based game.

Game controller 44 may be configured to render visual representation of the game play for carrying out the skill-based game based on the game data, and detect real-time or near real time game play of the skill-based game by the player.

Game controller 44 may compute a player skill level based on the detected game play by the player. The player skill level may be computed over a period of time for the detected real-time game play.

Game controller 44 may select game enhancement data generated by game processor 56 by comparing the game skill level and the player skill level.

Game controller 54 may modify the skill-based game using the selected game enhancement data to generate enhanced game play for the visual rendering. In some embodiments, when game controller 54 modifies the skill-based game using the selected game enhancement data, game components of the skill-based game may not be added, removed, or modified. Instead, the modification may relate to the game data of the skill-based game. For example, the skill-based game may be modified to be easier or more difficult.

Game controller 54 may detect additional game play data by the player of the enhanced skill-based game, award the player based on the additional game play and the comparison of the game skill level and the player skill level by triggering transfer of virtual credits to the player account of the player using the card reader and the token.

For example, a player may be playing a skill-based matching game as depicted in FIG. 6A through FIG. 6C. Among other limitations and requirements, the game data of the skill-based matching game may require the player to select two game tiles 602 comprising the same shape in succession. Game processor 56 may generate game enhancement data based on the game data of the skill-based matching game. For example, game processor 56 may generate game enhancement data corresponding to a game rule which may require the player to select more than two game tiles 602 comprising the same shape in succession. Game controller 44 may detect the game play data of the player to compute the skill level of the player, and compare the player's skill level of the game's skill level. Game controller 44 may compute that the player is excelling at the matching game. Game controller 44 may select game enhancement data corresponding to a game rule which may require the player to select more than two game tiles 602 for modifying the skill-based game to generate enhanced game play for visual rendering. After the game play has been enhanced with the game enhancement data, the player may have to select three game tiles 602 comprising the same shape in succession to win the matching game. Game controller 44 may detect additional game play data corresponding to whether the player selects three game tiles 602 comprising the same shape in succession and may award the player based on said additional game play data.

As another example, a player may be playing a skill-based maze game as depicted in FIG. 7 and FIG. 8. Among other limitations and requirements, the game data of the skill-based maze game may require the player to guide avatar 706 from entrance 702 to exit 704 within a certain period of time. Game processor 56 may generate game enhancement data based on the game data of the skill-based maze game. For example, game processor 56 may select game enhancement data corresponding to a game rule which may require the player to guide the avatar 706 to the exit 704 in less time than initially allowed. If game controller 44 computes that the player is excelling at the maze game, game controller 44 may select game enhancement data corresponding to a game rule which may require the player to guide the avatar 706 to the exit 704 in less time than initially allowed. As depicted in FIG. 7 and FIG. 8, the player may have one minute as per time meter 708 to finish the maze. After the game play has been enhanced with the game enhancement data, the player may have to guide avatar 706 through maze 700 in less than one minute, for example, thirty seconds.

In some embodiments, similar to the game enhancement elements, game processor 56 may have a reporting function that may generate reports relating to the characteristics and performance of the generated game enhancement data. For example, where the skill-based game is a skill-based matching game, game processor 56 may generate a report about how the game enhancement data may change the game play of the skill-based game, such as increasing the number of game tiles 602 that a player must select in succession to constitute a win.

As discussed herein, game controller 44 may select game enhancement elements and/or game enhancement data for modifying the skill-based game. When the game enhancement elements and game enhancement data modify the skill-based game, the game may be easier or more difficult. Gaming regulations may govern and restrict the degree and/or frequency with which the skill level of the skill-based game may be changed. In some embodiments, prior to modification of the skill-based game using game enhancement elements and/or game enhancement data, game controller 44 may send a control command to display controller 52 to dynamically update the rendering of the viewing area using graphics processor 54 to render visual representation of a notification prompt, tutorial, and/or acceptance notice on display screen 12, 14.

The notification prompt may comprise text and/or graphical animations that may notify the player that the skill level of the skill-based game is changing. The tutorial may comprise text and/or graphical animations that may teach the player about the game enhancement elements, game enhancement data, and/or new game functions and rules for playing the skill-based game. The acceptance notice may comprise text and/or graphical animations requiring the player to provide an input, such as pressing a button on playing input controls 50 or virtual buttons displayed on display screen 12, 14, representative of accepting the change in skill level of the skill-based game. In some embodiments, the player may choose for the skill level of the skill-based game to remain constant.

In some embodiments, a skill-based game on EGM 10 may be tested. EGM 10 may comprise data storage device 20 for storing game data of the skill-based game. EGM 10 may further comprise game processor 56 configured to automatically play the skill-based game using the game data to compute a game skill level, generate game testing agents based on the game data of the skill-based game, each game testing agent associated with a player skill level of a plurality of player skill levels for playing the skill-based game, automatically play the skill-based game using the game testing agents, determine game quality scores of the skill-based game based on game play data of the game testing agents, and output game test results for the skill-based game based on the game quality scores and the game skill level, the output game test results for automatically modifying the skill-based game.

The game testing agents generated by game processor 56 may play the skill-based game, and may generate game quality scores based on the game testing agents' play of the skill-based game. In some embodiments, the game testing agents may play the skill-based game to check if the game adheres to the game data, responds correctly to inputs, performs the game's functions within an acceptable time, functions as the game data intended, can be installed and run in its intended game environments, and achieves the general result as defined by the game data.

The game testing agents may play the game in a manner that may reflect the manner that a plurality of players may play the game, each player having a certain skill level. The game testing agents may play the game and identify bugs in the game and/or nuances in playing the game. In some embodiments, the game quality score of the skill-based game may reflect how well the game testing agent did when playing the skill-based game.

Game processor 56 may process the game quality scores to compute whether the game has any flaws. For example, for an acceptable skill-based game, a game testing agent corresponding to a player with a low skill level may find the skill-based game difficult. The game quality score for the game testing agent with low skill level may be low. Similarly, a game testing agent corresponding to a player with high skill level may find the skill-based game easy, and the game quality score may be high. However, for an unacceptable skill-based game, such as a game comprising an exploitable nuance, a game testing agent corresponding to a player with a low skill level may find the skill-based game easy, and the game quality score may be high. This may indicate that there may be a flaw in the skill-based game that the game testing agent with low skill may have discovered and exploited. Game processor 56 may identify this bug in the skill-based game for review and correction.

In some embodiments, game processor 56 may have a reporting function that may generate reports relating to the performance of the game testing agents and to report on the characteristics of the skill-based game being tested.

In some embodiments, game processor 56 may be separate from EGM 10, and may be connected to EGM 10 externally.

In some embodiments, the skill level of the player playing the skill-based game on EGM 10 computed by game controller 44 may be the skill level of a registered player or an anonymous player. A registered player may be a player that may be recognized by EGM 10 and/or EGM 10 may have game play data of the registered player stored on a local data storage device such as data storage device 20, or, if EGM 10 is connected as part of a network of gaming terminals such as system 900 as described in FIG. 9, a central data storage device. An anonymous player may be a player that the EGM 10 does not recognize and/or does not have game play data for the anonymous player.

The player may provide their player identity to EGM 10 by inserting a player tracking card into card reader slot 34. In some embodiments, the game player may be identified to the gaming system, for instance by inputting a user name and password when starting to play the skill-based game, through a game player account, a responsible gaming account, a social network account, or other suitable indicia of identification.

When a player registers to play the skill-based game on EGM 10, game controller 44 may collect game play data from the moment a player registers with EGM 10 or begins a skill-based game, for instance by pressing buttons on the player control inputs 50, or pressing a start button or otherwise providing an indication of a player's desire to play a skill-based game. In certain embodiments, the game play data may be detected from inputs received through EGM 10.

If the player is a registered player, then game play data of the player that may be stored at a local data storage device such as data storage device 20, or central data storage device (e.g. historical game play data) may be used by game controller 44 to determine the skill level of the player. In some embodiments, the skill level of the player computed by the game controller 44 during a previous game session may be stored at a local or central data storage device, and may be used by the game controller 44 to determine the skill level of the player during the current game session. In some embodiments, a combination of historical game play data and current game play data of the player may be used by game controller 44 to compute the skill level of the player.

If the player is not recognized by EGM 10 or does not register to play the skill-based game on EGM 10, the player may be an anonymous player. There may be no game play data stored on a local or central data storage device for the player. In such a case, game controller 44 may detect, in real time or near real time, the anonymous player's game play data, such as inputs from player control inputs 50, pressing virtual buttons displayed on display screen 12, 14, eye gaze data, player movement data, and the like. Based on this game play data, game controller 44 may compute the skill of the player. Game controller 44 may select game enhancement elements generated by game processor 56 for modifying the visual representation of the game play of the skill-based game by comparing the computed skill level of the player and the skill level of the game.

The skill level of an anonymous player may be computed by game controller 44 using a small amount of detected real time game play data (e.g. a single game session, or a few game sessions). As additional game play data is collected the computation of the player's skill level may be refined.

In some embodiments, the player may play a skill-based game with EGM 10 in communication with a mobile device. Depending on the game data of the skill-based game, the player may play the skill-based game on EGM 10, on the mobile device, or on both. The player may play the skill-based game using player control inputs 50, display screen 12, 14, their eye gaze, eye gestures, movement, the interface of the mobile device, or any combination thereof.

The player may play the skill-based game using the interface of the mobile device while the player holds on to the mobile device with one or more hands. The mobile device may, for example, be a computer, personal digital assistant, laptop, tablet, smart phone, media player, electronic reading device, data communication device, or a wearable device, such as Google™ Glass, virtual reality device, or any combination thereof. The mobile device may be a custom mobile device that may be in communication with EGM 10.

Figure 13:
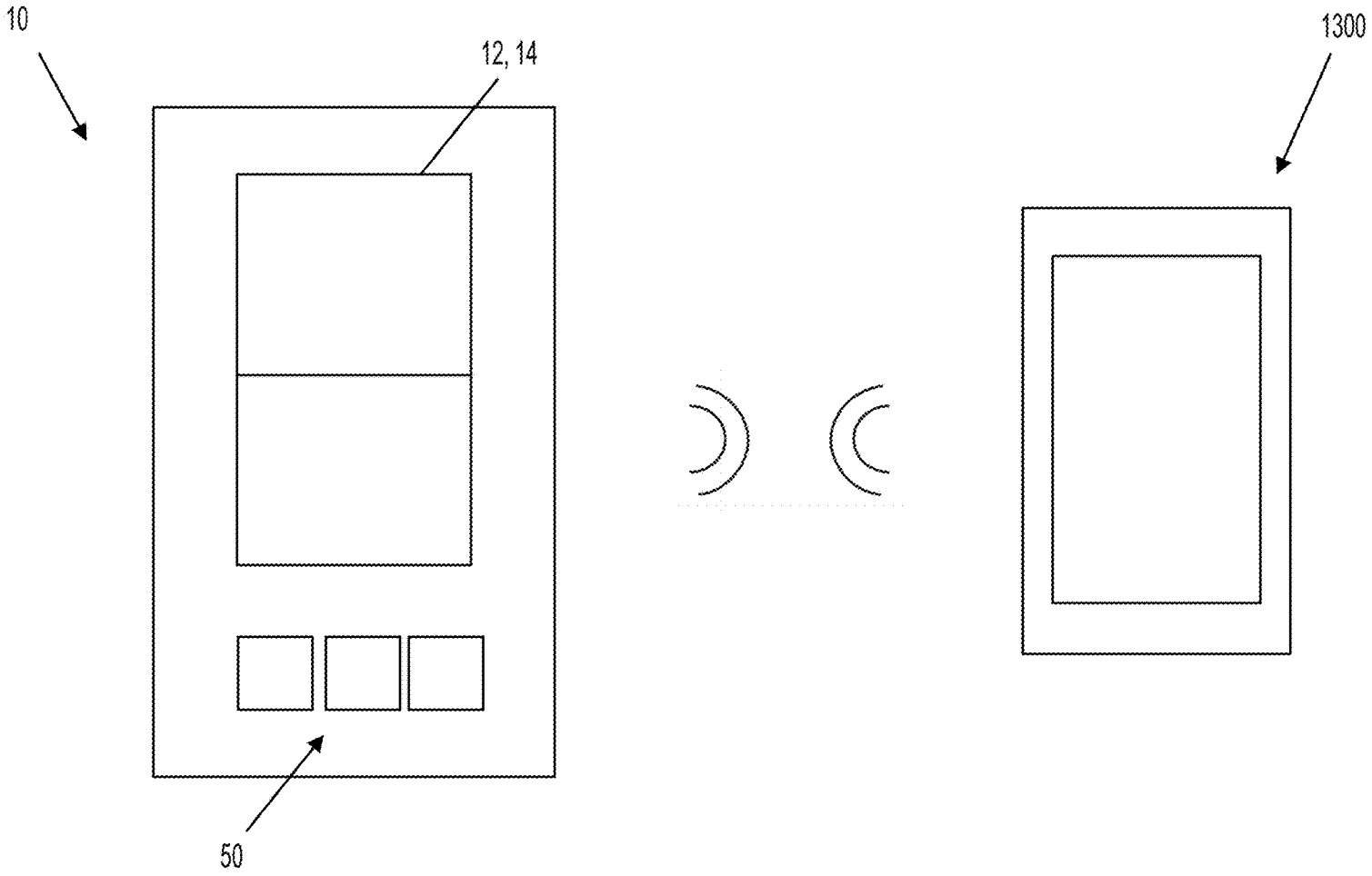
FIG. 13 is a schematic diagram illustrating an electronic gaming machine wirelessly communicating with a mobile gaming device according to some embodiments.

FIG. 13 illustrates a simplified EGM 10 wirelessly communicating with a mobile gaming device 1300. EGM 10 may be licensed for use in the particular jurisdiction (e.g., Nevada) in which it is operated. EGM 10 may instead be a server. In the example of FIG. 13, the mobile gaming device 1300 may be a tablet, such as an iPad™ tablet. EGM 10 may be played in a conventional manner as well as played remotely using mobile gaming device 1300.

Mobile gaming device 1300 may be operable by a user and may be any portable, networked (wired or wireless) computing device including a processor and memory and suitable for facilitating communication between one or more computing applications of mobile device (e.g. a computing application installed on or running on the mobile device). Mobile gaming device 1300 may be a two-way communication device with advanced data communication capabilities having the capability to communicate with other computer systems and devices. Mobile gaming device 1300 may include the capability for data communications and may also include the capability for voice communications, in some example embodiments. Mobile gaming device 1300 may have at least one data capture device to continuously detect the game play of a player to collect the player's game play data.

EGM 10 may include a wireless transceiver that may communicate with the mobile gaming device 1300, for example using standard WiFi or Bluetooth, or other protocol based on the wireless communication capabilities of the mobile gaming device 1300. The player may be able to play the skill-based game while the mobile gaming device 1300 is in communication with EGM 10. When connected to the EGM 10, the viewing area may be displayed on display screen 12, 14 or on the screen of the mobile gaming device 1300, or both. The at least one data capture device on the mobile device may detect game play data of the player, which may be processed by game controller 44 of EGM 10 and/or mobile gaming device 1300 to compute the skill level of the player. Game controller 44 may select a game enhancement element based on the skill level of the player. The game controller 44 may trigger a control command to the display controller 52 to dynamically update the rendering of the viewing area based on the selected game enhancement element. In response to the control command from the game controller 44, the display controller 52 may control the display screen 12, 14, the mobile gaming device 1300, or both, in real-time or near real-time using the graphics processor 54 to dynamically update the rendering of the viewing area to provide a real-time or near real-time graphical animation effect displayed on the display screen 12, 14 or the mobile gaming device 1300 representative of a visual update to the game components in the viewing area, the visual update based on the selected game enhancement element.

In some embodiments, the mobile gaming device 1300 in communication with EGM 10 may be configured to be a display screen that compliments display screen 12, 14 when playing the skill-based game. The player may interact with the skill-based game through the interface of the mobile gaming device 1300, through the EGM 10, or any combination thereof. The interactive game environment, viewing area, and game components of the skill-based game may be displayed on the mobile gaming device 1300, display screen 12, 14, or any combination thereof.

In some embodiments, a terminal may be connected to one or more EGM 10 over a network. The terminal may serve as a registration terminal for setting up the communication between the mobile gaming device 1300 and any EGM 10 connected to the network. Therefore, the player does not have to physically go to EGM 10 to set up the link and play the skill-based game associated with EGM 10.

Figure 14:
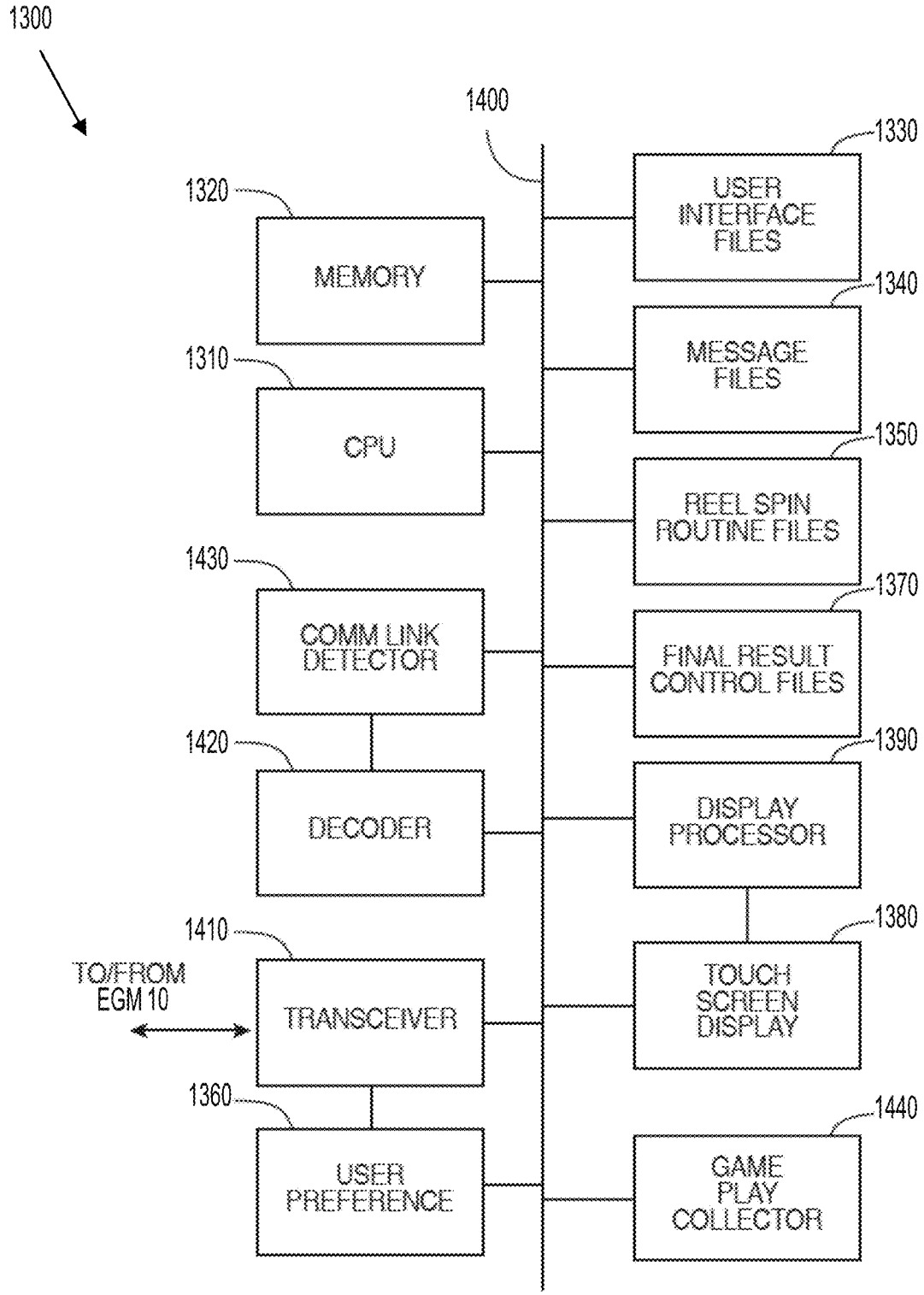
FIG. 14 a schematic diagram illustrating various functional units and program files in a mobile gaming device according to some embodiments.

FIG. 14 illustrates some pertinent functional elements in mobile gaming device 1300 used for the remote play.

Mobile gaming device includes at least one CPU 1310 for carrying out the game and support functions. A memory 1320 (RAM and ROM) stores the game data, game program files, game play data, and other files for remote gaming. Such files may be downloaded from a website or server, or may be retrieved from a local or central data storage device, for example. The user interface files 1330 for carrying out the game, the display message files 1340, the reel spin routine files 1350, user preferences 1360 and final result control files 1370 are shown separately but are stored in the memory 1320. The display messages files 1340 contains messages that are displayed automatically if the communications link between the tablet and gaming machine is broken, as well as contains other messages. User preferences 1360 may store attributes about the user such as gender, location, registration number, user identifier, address, phone number, occupation, credit score, game preferences, privacy preferences, and so on.

The touch screen display 1380 displays the game and user interface. A display processor 1390 receives high level instructions from the bus 1400 and generates pixel control signals for the touch screen display 1380.

A transceiver 1410 (e.g. WiFi and/or Bluetooth transceiver, or other protocol) generates and receives wireless signals for communicating with the transceiver in EGM 10. A decoder 1420 (e.g., a modulator/demodulator) converts received signals to digital (baseband) signals and converts signals to be transmitted to the appropriate format signals. The decoder 1420, in combination with the CPU 1310, carries out the required protocols for establishing the communications link, performing encryption/decryption, etc.

A communications link detector 1430 detects that the communications link between the mobile gaming device 1300 and the gaming machine 10 has been broken, such as by the player moving out of the play area, interference, etc.

A game play collector 1440 detects game play on mobile gaming device 1300 and collects game play data in real-time or near-real time for game controller 44 to compute the skill level of the player. The memory 1320 may also contain historical game play data files, or a reference or index to historical game play data files stored on an external server. The historical game play data may also be used by game controller 44 to determine the skill level of the player. Preference data stored as user preferences may also be used by game controller 44 for selecting game enhancement elements for modifying the visual representation of the game play of the skill-based game. Game controller 44 may be configured to determine the skill level of the player and/or select game enhancement elements based on detected game play data from EGM 10 and/or mobile gaming device 1300.

In some embodiments, EGM 10 may generate game enhancement elements, game enhancement data, and/or game testing agents that may reflect a diverse range of players with a diverse range of game play behaviours and tendencies. When adding, removing, or modifying game components with a game enhancement element, or generating simulated player robots for a skill-based game, the game enhancement elements reflect a range of skills and play styles. A skill-based game be implemented with access to a database containing sufficient game enhancement elements with a variety in skill level and game play behaviours and tendencies. The game enhancement elements, such as the simulated player robots, may have a similar skill level to the player for the player to have an engaging game experience. The game enhancement elements, game enhancement data, and/or game testing agents generated by game processor 56 may reflect players with a range of skill levels and play styles. The game enhancement elements modifying the visual representation of the skill-based game may not be too challenging or too easy. The game enhancement elements may generate a game skill level that may be similar in skill level to the player, such that the player may be engaged when playing the game. Also, the skill level of the player may change over time. EGM 10 may continuously detect the game play of the player and compute the skill level of the player, and automatically modify the visual representation of the game play with game enhancement elements that may challenge the player but may not discourage the player. This may provide a better game play experience to the player. Further, the skill-based game may have replay value as the game enhancement elements modify the visual representation of the game play of the skill-based game, or the difficulty of the skill-based game, so game play experience may not be the same each time the game is played.

In some embodiments, game processor 56 of EGM 10 may generate game enhancement elements, game enhancement data, and/or game testing agents based on the game data of the skill-based game. Game processor 56 may generate game enhancement elements, game enhancement data, and/or game testing agents automatically based on the game data, rather than being hard coded to learn a particular game. This may allow game data of different types of skill-based games to be stored and run on EGM 10.

When testing a skill-based game, it may be necessary to test the game with end users in mind. The game testing may be of poor quality if it was assumed that all players of the skill-based game may have the same level of skill. Good skill-based games may be able to accommodate a range of players with a range of skills. In some embodiments, EGM 10 may test and debug skill-based games by generating game testing agents from the game data. Skill-based games may be difficult to design and test as compared to games that may not require skill, as the game may need to be tested for a range of players with a range of skills and play behaviours. EGM 10 may generate a plurality of game testing agents corresponding to a plurality of players with a range of skills and play behaviours to test and debug the skill-based game. This may improve the quality of the game testing and debugging, and the quality of the skill-based game such that a player may be engaged when playing the skill-based game.

Playing a skill-based game on EGM 10 may present benefits. When playing a skill-based game with other actual people, a minimum number of people may be required to play the game. When playing a skill-based game on EGM 10, if other players are needed but unavailable, game processor 56 may generate simulated player robots to play the skill-based game with the player. There may also a level of intimidation when playing a skill-based game in the presence of other actual people, who may be highly skilled at the skill-based game. When playing the game using EGM 10, the player may feel he or she has a chance to win as the game controller 44 may select game enhancement elements with skill levels that may be similar to the skill level of the player. This may engage the player when playing the skill-based game. Actual human opponents may try to dominate and beat the player in the skill-based game, which may not be an engaging experience, especially if the skill levels of the human opponents may be higher than the skill level of the player. EGM 10 may also detect when players are cheating when playing the skill-based game, so a player playing the game using EGM 10 may find comfort knowing that other players may not cheat, for example, when playing a multi-player skill-based game.

The embodiments of the devices, systems and methods described herein may be implemented in a combination of both hardware and software. These embodiments may be implemented on programmable computers, each computer including at least one processor, a data storage system (including volatile memory or non-volatile memory or other data storage elements or a combination thereof), and at least one communication interface.

Program code is applied to input data to perform the functions described herein and to generate output information. The output information is applied to one or more output devices. In some embodiments, the communication interface may be a network communication interface. In embodiments in which elements may be combined, the communication interface may be a software communication interface, such as those for inter-process communication. In still other embodiments, there may be a combination of communication interfaces implemented as hardware, software, and combination thereof.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions. The devices provide improved computer solutions for hardware limitations such as display screen, display screen, and so on.

The foregoing discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Embodiments described herein may be implemented by using hardware only or by using software and a necessary universal hardware platform. Based on such understandings, the technical solution of embodiments may be in the form of a software product. The software product may be stored in a non-volatile or non-transitory storage medium, which can be a compact disk read-only memory (CD-ROM), USB flash disk, or a removable hard disk. The software product includes a number of instructions that enable a computer device (personal computer, server, or network device) to execute the methods provided by the embodiments.

The embodiments described herein are implemented by physical computer hardware. The embodiments described herein provide useful physical machines and particularly configured computer hardware arrangements. The embodiments described herein are directed to electronic machines methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components. Substituting the computing devices, servers, receivers, transmitters, processors, memory, display, networks particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

For example, and without limitation, the computing device may be a server, network appliance, set-top box, embedded device, computer expansion module, personal computer, laptop, personal data assistant, cellular telephone, smartphone device, UMPC tablets, video display terminal, gaming console, electronic reading device, and wireless hypermedia device or any other computing device capable of being configured to carry out the methods described herein.

Although the embodiments have been described in detail, it should be understood that various changes, substitutions and alterations can be made herein without departing from the scope as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only.

What is claimed is:

1. A device for a skill-based game comprising:

a data storage device for storing game data for the skill-based game;

a card reader to receive a token for a player account of a player to initiate the skill-based game; a display screen for displaying the skill-based game;

a game processor configured to automatically generate game enhancement elements using the game data and to automatically play the skill-based game using the game data to compute a game skill level;

a game controller connected to the data storage device and the display screen to control the skill-based game, the game controller configured to: render visual representation of game play for carrying out the skill-based game based on the game data on the display screen;

detect real-time game play of the skill-based game by the player;

compute a player skill level based on the detected game play by the player;

select one or more game enhancement elements by comparing the game skill level and the player skill level each game enhancement element linked to the comparison of the game skill level and the player skill level;

modify the visual representation of the game play using graphical animation effects based on the one or more selected game enhancement elements to generate an enhanced skill-based game;

detect additional real-time game play by the player of the enhanced skill-based game, the additional real-time game play involving interaction with the one or more generated game enhancement elements; and award the player based on the additional game play and the comparison of the game skill level and the player skill level by triggering transfer of virtual credits to the player account of the player using the card reader and the token;

wherein the game processor generates the game enhancement elements by repeatedly:

randomly generating preliminary game enhancement elements based on the game data for selecting to modify the skill-based game;

evaluating the preliminary game enhancement elements with a fitness score;

selecting at least one of the preliminary game enhancement elements for modification based on the fitness score;

modifying the selected at least one preliminary game enhancement element to provide a modified preliminary game enhancement element; and replacing the selected at least one preliminary game enhancement element with the modified preliminary game enhancement element;

until satisfying a stop criteria, the stop criteria defining a set of game enhancement elements corresponding to a plurality of skill levels for playing the skill-based game.

2. The device of claim 1, wherein the one or more generated game enhancement elements comprise modifying, adding, or removing game components for the skill-based game.

3. The device of claim 1, wherein the game enhancement elements comprise a simulated player robot configured to interface with the device to automatically play the skill-based game to compute the game skill level.

4. The device of claim 1, wherein the game controller computes the player skill level using skill-determining factors.

5. The device of claim 4, wherein the skill-determining factors comprise one or more of:

reaction time, memory, coordination, game session length, play behavior, game behavior, game language, game location, game selection, elapsed time with one game, wagering behavior, game type, game theme, wager amounts, wager denominations, play rates, typical bonus values, game brand, prize distributions, amounts of incremental wagers, frequency of wagering, for instance the presence or absence of multiple rounds of wagering in a game, number of rounds of wagers permitted in a game, maximum wager amounts permitted, minimum wager amounts permitted, amount of wagering, elapsed time between selected events for instance starting a new game, reaction to bonus rounds, reaction to progressive outputs, pay table features, amount of incremental wagers, frequency of wagering, elapsed time for player reaction, amount of wagering, elapsed time between wagers, frequency of player action, game rules, game complexity, ability for a player to control or have an effect on a game outcome, whether an outcome is predetermined, whether parallel wagering is provided, average game speed, average wager amounts, average wager rate, presence or frequency of bonus rounds, presence and frequency of progressive outputs, payout percentages, win rates, win percentages, loss rates, loss percentages, use of special features, frequency of use of special features, number of lines played, total amount wagered, and type of payment received.

6. The device of claim 1, wherein the game controller awards the player based on a portion of additional game play data corresponding to the player's interaction with the game enhancement elements.

7. The device of claim 1, wherein:

the data storage device stores bonus game data for a bonus game in the data storage device; and the game controller is further configured to trigger a bonus game based on additional game play data and the comparison of the game skill level and the player skill level, the bonus game including game enhancement elements.

8. The device of claim 1, wherein at least a portion of the device is implement using a central server coupled to a plurality of gaming machines, and wherein the game controller is further configured to:

detect real-time game play of the skill-based game by the player at a first gaming machine;

receive from the first gaming machine, game data for the skill-based game and a request to generate the game enhancement elements; and distribute to each of the plurality of gaming machines, the one or more generated game enhancement elements.

9. The device of claim 1, wherein the player skill level is determined in real time or near real time.

10. The device of claim 1, wherein the game processor generates the game enhancement elements in real time or near real time.

11. The device of claim 1 wherein the game controller is configured to:

procedurally generate game data; and carry out the skill-based game based on the game data and the procedurally generated game data by the visual rendering on the display screen.

12. The device of claim 1 wherein the game controller is configured to:

generate the game enhancement elements based on the game data of the skill-based game while the skill-based game is loading.

13. The device of claim 1 wherein the game controller is configured to:

receive input of a preference of the player; and identify the game enhancement element for introducing to the skill-based game based on the preference of the player.

14. The device of claim 1, wherein the game processor is configured to:

generate an optimal simulated player based on the game data for the skill-based game, the optimal simulated player corresponding to an optimal skill level for playing the skill-based game;

compute the game skill level using the optimal simulated player; and determine whether the player is cheating by comparing the player skill level and to the game skill level as computed using the optimal simulated player.

15. The device of claim 1, wherein the skill-based game is a single-player skill-based game or a multi-player skill-based game.

16. A device for playing a skill-based game, the device comprising:

a data storage device for storing game data for the skill-based game;

a card reader to receive a token for a player account of a player to initiate the skill-based game;

a display screen for providing a visual rendering for the skill-based game; a game processor configured to automatically generate game enhancement data using the game data and to automatically play the skill-based game using the game data to compute a game skill level;

a game controller connected to the data storage device and the display screen to control the skill-based game, the game controller configured to:

render visual representation of game play for carrying out the skill-based game based on the game data;

detect real-time game play of the skill-based game by the player;

compute a player skill level based on the detected game play by the player, the player skill level over a period of time for the detected real-time game play;

select game enhancement data by comparing the game skill level and the player skill level;

modify the skill-based game using graphical animation effects based on the selected game enhancement data to generate enhanced game play for the visual rendering;

detect additional game play data by the player of the skill-based game after modification of the skill-based game using the graphical animation effects; and award the player based on the additional game play and the comparison of the game skill level and the player skill level by triggering transfer of virtual credits to the player account of the player using the card reader and the token;

wherein the game processor generates the game enhancement elements by repeatedly:

randomly generating preliminary game enhancement elements based on the game data for selecting to modify the skill-based game;

evaluating the preliminary game enhancement elements with a fitness score;

selecting at least one of the preliminary game enhancement elements for modification based on the fitness score;

modifying the selected at least one preliminary game enhancement element to provide a modified preliminary game enhancement element; and replacing the selected at least one preliminary game enhancement element with the modified preliminary game enhancement element;

until satisfying a stop criteria, the stop criteria defining a set of game enhancement elements corresponding to a plurality of skill levels for playing the skill-based game.

17. A device for testing a skill-based game, the device comprising:

a data storage device for storing game data for the skill-based game; and a game processor configured to:

automatically play the skill-based game using the game data to compute a game skill level;

generate game testing agents based on the game data for the skill-based game, each game testing agent associated with a player skill level of a plurality of player skill levels for playing the skill-based game;

automatically play the skill-based game using the game testing agents;

determine game quality scores of the skill-based game based on game play data of the game testing agents; and output game test results for the skill-based game based on the game quality scores and the game skill level, the output game test results for automatically modifying the skill-based game;

wherein the game processor generates the game testing agents by repeatedly:

randomly generating preliminary game testing agents based on the game data for testing the skill-based game;

evaluating the preliminary game testing agents with a fitness score;

selecting at least one of the preliminary game testing agents for modification based on the fitness score;

modifying the selected at least one preliminary game testing agents to provide modified preliminary game testing agents; and replacing the preliminary game testing agents with the modified preliminary game testing agents;

until satisfying a stop criteria, the stop criteria defining a set of game testing agents corresponding to a plurality of skill levels for testing the skill-based game.

18. The device of claim 17, wherein the game quality scores are determined based on adherence of the skill-based game to the game data, responses to game play, performance of game functions within an acceptable time, functionality of the skill-based game as the game data intended, operability of the skill-based game on the device, and achievement of game results as defined by the game data.

* * * * *